US012503874B1

(12) United States Patent
Skousen et al.

(10) Patent No.: US 12,503,874 B1
(45) Date of Patent: Dec. 23, 2025

(54) BRACKET HOUSING SYSTEM AND POOL-COVER BRACKET APPARATUS

(71) Applicant: SKOUSEN MANUFACTURING LIMITED LIABILITY COMPANY, Rigby, ID (US)

(72) Inventors: Robert Skousen, Rigby, ID (US); Kurtis Skousen, Rigby, ID (US); Adam Marble, Rigby, ID (US)

( * ) Notice: Subject to any disclaimer, the term of this patent is extended or adjusted under 35 U.S.C. 154(b) by 0 days.

(21) Appl. No.: 19/293,137

(22) Filed: Aug. 7, 2025

(51) Int. Cl.
*E04H 4/10* (2006.01)

(52) U.S. Cl.
CPC ..... *E04H 4/108* (2013.01); *E04H 4/101* (2013.01)

(58) Field of Classification Search
CPC ..... E04H 4/108; E04H 4/101
USPC ..... 4/498, 494–495; 482/55; 126/17.1; 135/87; 220/216
See application file for complete search history.

(56) References Cited

U.S. PATENT DOCUMENTS 2,292,370 A * 8/1942 Ferngren ..... C03B 9/24 65/219
3,412,409 A * 11/1968 Putney ..... E04H 4/08 D25/2
3,766,691 A * 10/1973 Ray ..... E04B 7/166 52/71
3,836,162 A * 9/1974 Felkner ..... F25D 23/00 108/7
3,899,085 A * 8/1975 Chaparro ..... B07C 5/344 198/465.1
4,005,845 A * 2/1977 Luppi ..... E02F 9/166 248/419
4,686,717 A * 8/1987 MacDonald ..... E04H 4/101 4/502
4,744,471 A * 5/1988 Leister ..... E04H 4/10 211/105.6
4,853,985 A * 8/1989 Perry ..... B65F 1/1623 49/248
4,858,253 A * 8/1989 Lamb ..... E04H 4/101 4/502
4,937,896 A * 7/1990 Niimura ..... E04H 4/065 52/126.5
5,025,512 A * 6/1991 Niimura ..... E04H 4/065 187/360
5,105,481 A * 4/1992 Lamb ..... E04H 4/101 4/502

(Continued)

FOREIGN PATENT DOCUMENTS

AU 2003202313 A1 * 9/2003
CA 2180055 A1 * 12/1997 ..... E04H 4/101

(Continued)

*Primary Examiner* — Lori L Baker

(57) ABSTRACT

A bracket housing system and pool-cover bracket apparatus may work in tandem with each other or independently. The pool-cover bracket apparatus may come in a variety of configurations and sizes. The bracket housing system may include a trough and pool-cover brackets that are removably attachable to the trough. The pool-cover bracket apparatus may include a first bracket, a second bracket, a third bracket, and a fourth bracket. Some of the pool-cover brackets may be interchangeable and used in the trough. Each of the pool-cover brackets may include a front section that is coupleable to a rear section. The front section may vary in length so as to accommodate different pool cover sizes.

20 Claims, 21 Drawing Sheets

(56) References Cited

U.S. PATENT DOCUMENTS 5,107,551 A * 4/1992 Weir ..... E04H 4/14 4/496
5,127,699 A * 7/1992 Maezawa ..... E02F 9/166 180/326
5,371,907 A * 12/1994 Horvath ..... E04H 4/108 4/498
5,425,143 A * 6/1995 Kalandovsky ..... E04H 4/101 242/564.2
5,426,899 A * 6/1995 Jones ..... E04B 7/14 52/63
5,800,089 A * 9/1998 Donaton ..... E04H 4/10 403/4
5,916,099 A * 6/1999 Hall ..... E04H 4/144 4/496
5,937,881 A * 8/1999 Villa ..... A45B 23/00 135/21
5,970,531 A * 10/1999 Demby ..... E04H 4/108 52/643
6,149,376 A * 11/2000 Peting ..... B22D 13/10 414/746.3
6,324,706 B1 * 12/2001 Epple ..... E04H 4/101 4/502
6,355,180 B1 * 3/2002 Valentine ..... F24S 10/17 210/776
6,381,767 B1 * 5/2002 Brashears ..... E04H 4/108 135/124
6,431,488 B1 * 8/2002 Zemla ..... E04H 4/101 4/502
6,442,773 B1 * 9/2002 Kopyar ..... E04H 4/108 4/498
6,446,276 B2 * 9/2002 Mathis ..... E04H 4/101 4/502
6,487,734 B1 * 12/2002 First ..... E04H 4/108 4/503
6,769,142 B2 * 8/2004 Ragsdale ..... E04H 4/101 160/331
6,827,120 B2 * 12/2004 Last ..... E04H 4/101 160/133
7,204,291 B2 * 4/2007 Last ..... E04H 4/101 74/25
7,209,176 B2 * 4/2007 Chapman ..... F16M 11/42 396/428
7,225,479 B2 * 6/2007 Katt ..... E04H 4/08 211/70.5
7,694,356 B2 * 4/2010 Bouiss ..... E04H 4/101 4/502
7,926,497 B2 * 4/2011 Young ..... A45B 17/00 135/20.1
8,051,505 B1 * 11/2011 Horton ..... E04H 4/084 4/503
8,328,648 B2 * 12/2012 Molinar ..... F16D 3/841 248/300
8,371,070 B2 * 2/2013 Jackson ..... E04H 4/086 52/3
8,438,671 B2 * 5/2013 Last ..... E04H 4/141 4/502
9,353,539 B2 * 5/2016 Shebek ..... E04H 4/00
9,527,552 B2 * 12/2016 Hey ..... B63C 3/06
9,593,499 B1 * 3/2017 Barba, III ..... E04H 4/086
9,777,496 B2 * 10/2017 Karales ..... E04H 4/10
10,428,545 B2 * 10/2019 Woods ..... E04H 4/101
10,876,309 B2 * 12/2020 Lewis ..... E04H 4/10
11,028,606 B1 * 6/2021 Ovalle ..... E04C 3/005
11,085,197 B2 * 8/2021 Prior ..... E04H 4/14
11,274,459 B2 * 3/2022 Ovalle ..... E04B 5/026
11,560,733 B2 * 1/2023 Volin ..... E04H 15/44
11,814,867 B2 * 11/2023 Prior ..... F16L 9/128
11,828,079 B2 * 11/2023 Hageman ..... G08B 21/182
12,221,803 B2 * 2/2025 Huang ..... B32B 27/36
2007/0199141 A1 * 8/2007 Johnston ..... E04H 4/108 4/498
2007/0199142 A1 * 8/2007 Gray ..... E04H 4/08 4/498
2007/0294817 A1 * 12/2007 Drechsel ..... E04H 4/101 4/498
2008/0256698 A1 * 10/2008 Smart ..... E04H 4/084 4/498
2009/0025303 A1 * 1/2009 Gramling ..... E04D 13/076 248/48.1
2011/0099917 A1 * 5/2011 Gramling ..... E04D 13/0725 52/12
2011/0114800 A1 * 5/2011 Gramling ..... E04D 13/0727 52/12
2014/0000021 A1 * 1/2014 Scheps ..... E04H 4/101 4/498
2014/0007338 A1 * 1/2014 Shpringer ..... E04H 4/082 4/498
2014/0237713 A1 * 8/2014 Kanetis ..... E04H 4/065 4/490
2015/0096115 A1 * 4/2015 Shebek ..... E04H 4/00 29/525.08
2015/0101116 A1 * 4/2015 Stien ..... E04H 4/082 4/498
2023/0131973 A1 * 4/2023 Fisher ..... E04H 4/08 4/498

FOREIGN PATENT DOCUMENTS

CA 2609289 A1 * 12/2006 ..... F16M 11/10
CN 208830785 U * 5/2019
CN 115116905 A * 9/2022 ..... B08B 3/022
CN 117489162 A * 2/2024 ..... E04H 4/084
CN 118491003 A * 8/2024 ..... A62B 9/04
CN 221490544 U * 8/2024
CZ 2005547 A3 * 3/2007 ..... E04H 4/108
JP H09510760 A * 10/1997 ..... E06B 9/70
WO WO-2005120421 A1 * 12/2005 ..... A61G 7/1096
WO WO-2010077695 A1 * 7/2010 ..... E04H 4/10
WO WO-2023122340 A1 * 6/2023 ..... E04H 4/065

* cited by examiner

BRACKET HOUSING SYSTEM AND POOL-COVER BRACKET APPARATUS

CROSS-REFERENCE TO RELATED APPLICATIONS

Not applicable.

TECHNICAL FIELD

The present disclosure relates to a bracket for a pool cover. More particularly, the present disclosure relates to a pool cover bracket and a system that utilizes the pool cover bracket so as to assist a user in installing and maintaining a pool-cover system.

BACKGROUND

Swimming pools have been a part of the world's history for thousands of years with some of the earliest pools being found in ancient Greece and Rome. To maintain these pools, there would have to be constant draining, scrubbing and skimming so as to remove debris from the water. This was and is often time consuming and laborious.

In an attempt to address various aspects of maintaining a pool, companies developed pool covers, with some of these covers being automatic. Pool covers offer numerous benefits. As an example, pool covers decrease or eliminate pool water evaporation, help maintain pool water temperature, keep debris out of the pool, and increase safety by preventing children and pets from falling into the pool water. These benefits lead to decreased pool maintenance, thereby lowering cost for pool owners.

While pool covers and automatic pool covers have many inherent benefits, there are also downsides to them. These may include high maintenance costs, overheating pool water, and mechanical failures with motors and/or brackets. Often brackets are of poor design and quality, which leads to torn pool covers and sometimes broken brackets and pool cover systems.

Accordingly, there is a need for a well-designed, strong, and easy to use bracket for automatic pool cover systems. The present invention seeks to solve these and other problems.

SUMMARY OF EXAMPLE EMBODIMENTS

In one embodiment, a bracket housing system and pool-cover bracket apparatus may work in tandem with each other or independently. The pool-cover bracket apparatus may come in a variety of configurations and sizes. The bracket housing system may include a trough and pool-cover brackets that are removably attachable to the trough. The trough may include a front side, a rear side, a top, a bottom, a left side, and a right side. A lip may rest on and overhang the top edges of the front, left, and right sides. The front side of the trough may include a cutaway portion that runs a majority of the length of the front side. The rear side of the trough may include a plurality of supports that extend from a top of the rear side proximate the lip and descend to the bottom. The rear side may also include a rear bracket that is coupled proximate the top of the rear side. The rear bracket may include a plurality of slots that are configured to receive ends of the plurality of supports so as to secure them therein.

The trough may include a cavity that is configured to receive certain sizes of the pool-cover brackets. The pool-cover bracket apparatuses may include a first bracket, a second bracket, a third bracket, and a fourth bracket. Some of the pool-cover brackets may be interchangeable and used in the trough. Each of the pool-cover brackets may include a front section that is coupleable to a rear section. The front section may vary in length so as to accommodate different pool cover sizes. As an example, an upper section of the front section may be 13", 16", 18", 21", 27", 29", or any other length.

DETAILED DESCRIPTION OF EXAMPLE EMBODIMENTS

Figure 1:
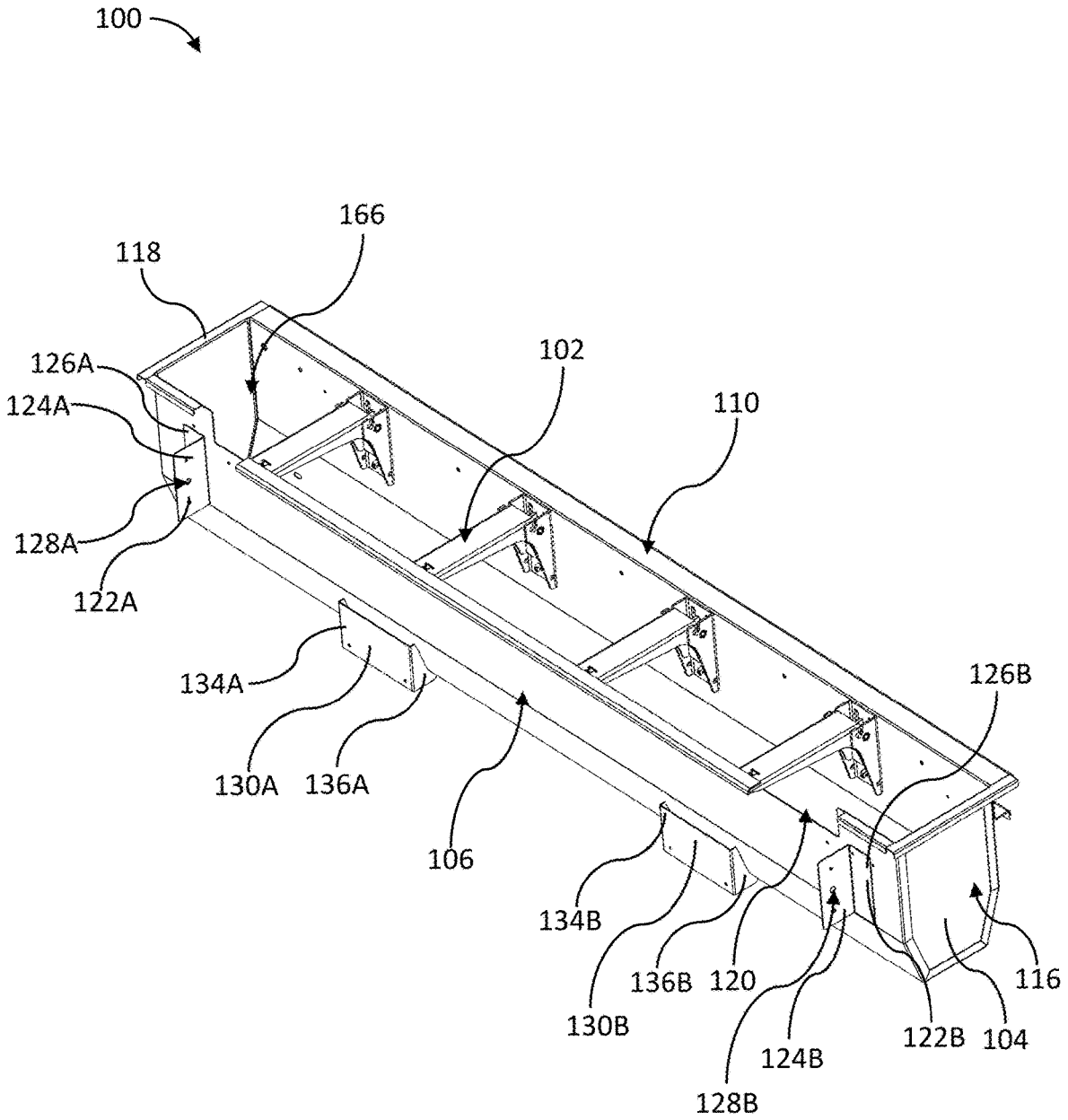
FIG. 1 illustrates a front perspective view of a bracket housing system and pool-cover bracket apparatus.

While embodiments of the present disclosure may be subject to various modifications and alternative forms, specific embodiments have been shown by way of example in the drawings and will be described in detail herein. However, the present disclosure is not intended to be limited to the particular features, forms, components, etc. disclosed.

Rather, the present disclosure will cover all modifications, equivalents, and alternatives falling within the scope of the present disclosure.

Reference to the invention, the present disclosure, or the like are not intended to restrict or limit the invention, the present disclosure, or the like to exact features or steps of any one or more of the exemplary embodiments disclosed herein. References to "one embodiment," "an embodiment," "alternate embodiments," "some embodiments," and the like, may indicate that the embodiment(s) so described may include a particular feature, structure, or characteristic, but not every embodiment necessarily includes the particular feature, structure, or characteristic.

Any arrangements herein are meant to be illustrative and do not limit the invention's scope. Although specific terms are employed herein, they are used in a generic and descriptive sense only and not for purposes of limitation. Unless otherwise defined herein, such terms are intended to be given their ordinary meaning not inconsistent with that applicable in the relevant industry and without restriction to any specific embodiment hereinafter described. Certain terms are used herein, such as "comprising" and "including," and similar terms are meant to be "open" and not "closed" terms.

It will be understood that the steps of any such processes or methods are not limited to being carried out in any particular sequence, arrangement, or with any particular graphics or interface. In fact, the steps of the disclosed processes or methods generally may be carried out in various, different sequences and arrangements while still being in the scope of the present invention.

As previously described, there is a need for a well-designed, strong, and easy to use bracket for automatic pool cover systems. The present invention seeks to solve these and other problems.

While swimming pools have been around for thousands of years, it wasn't until the last century that pool covers and automatic pool covers emerged. With the emergence of these covers, there would be less maintenance, cleaning, and evaporation. Even with this unique and needed invention, there are still shortcomings prevalent in automatic pool cover systems. Some of these issues may be present in the design of the system, such as its brackets, the motor mechanism, and/or the cover. More specifically, many brackets used in modern-day automatic pool cover systems may be weak, created from substandard materials, and include design flaws.

The bracket housing system and pool-cover bracket apparatus described herein includes a trough that receives and houses a rolled pool cover. The trough may be configured to receive a plurality of brackets. The trough may be configured to receive different types and sizes of brackets. It will be appreciated that the brackets are simple to use, sturdy, and increase the life span of a pool cover system.

Figure 2:
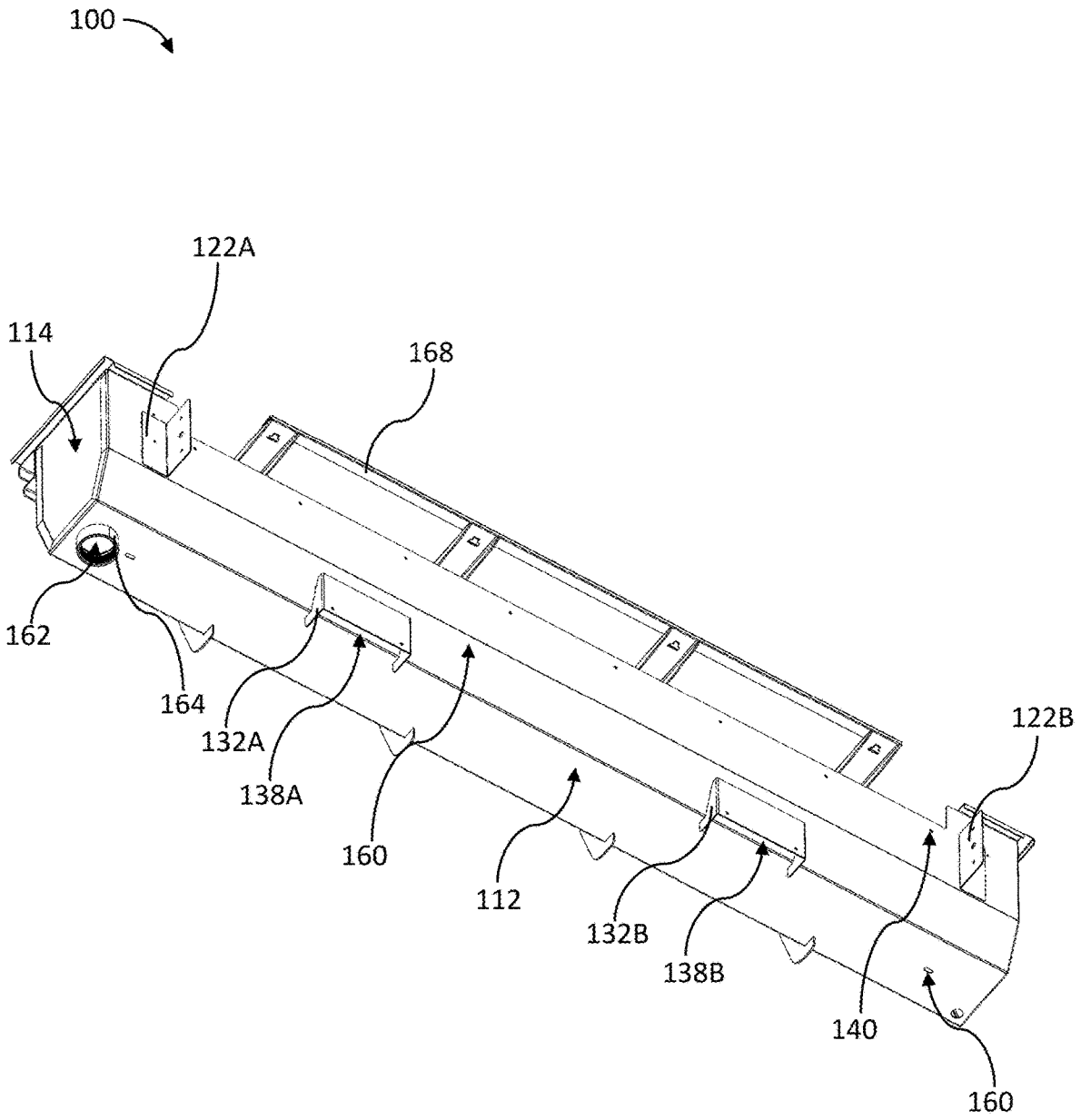
FIG. 2 illustrates a bottom perspective view of a bracket housing system and pool-cover bracket apparatus.
Figure 3:
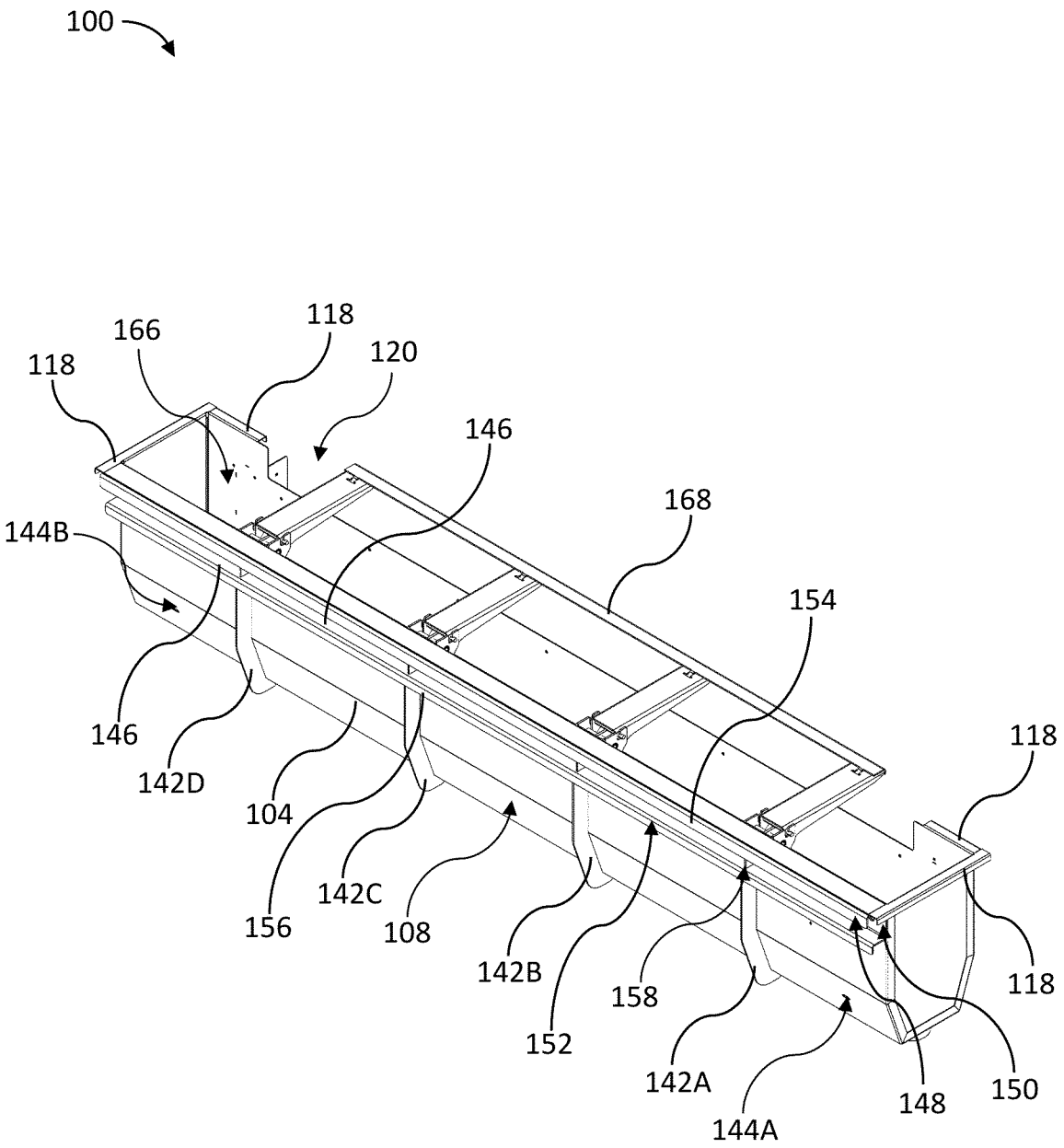
FIG. 3 illustrates a rear perspective view of a bracket housing system and pool-cover bracket apparatus.
Figure 4:
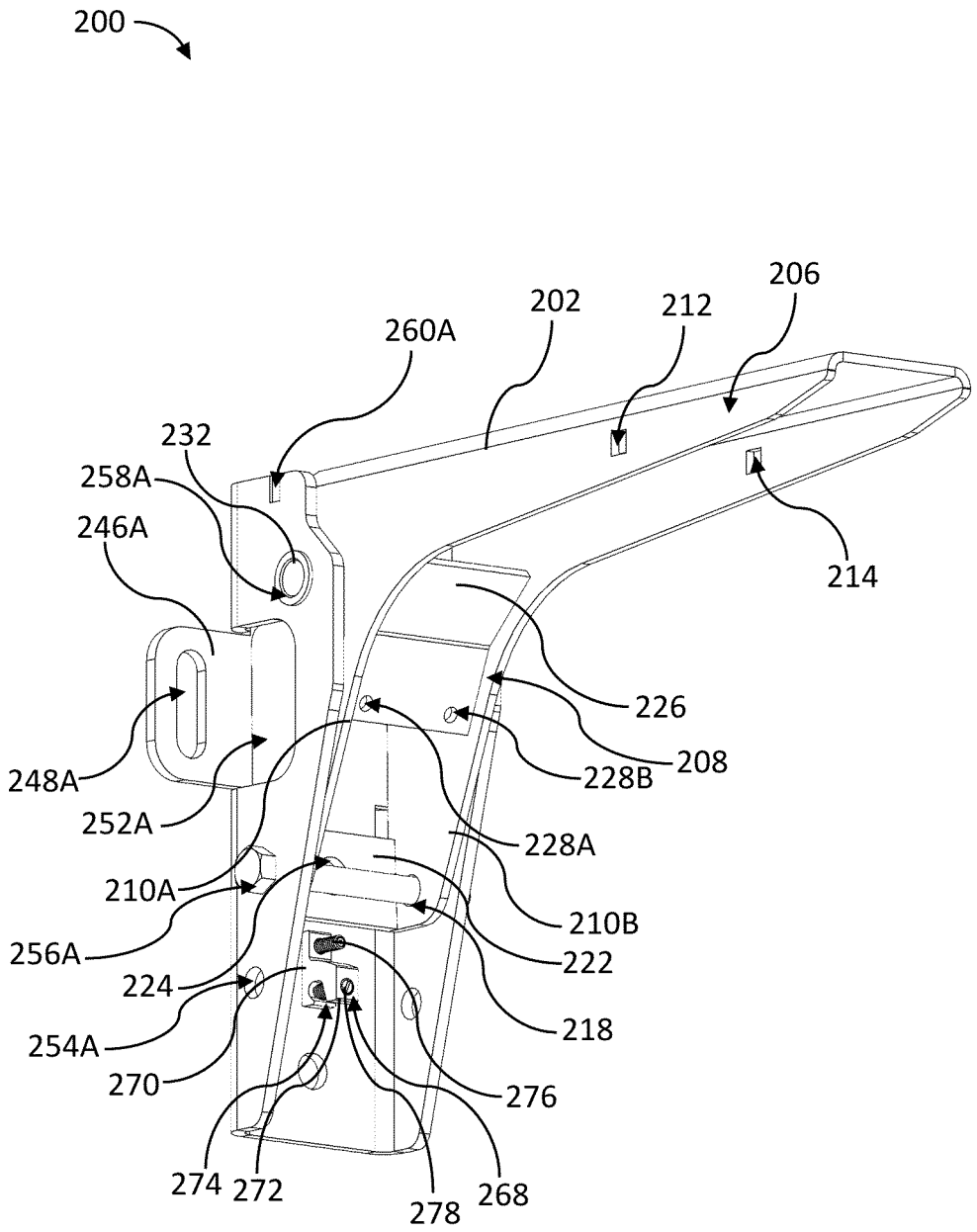
FIG. 4 illustrates a left side perspective view of a first bracket of a pool-cover bracket apparatus.
Figure 5:
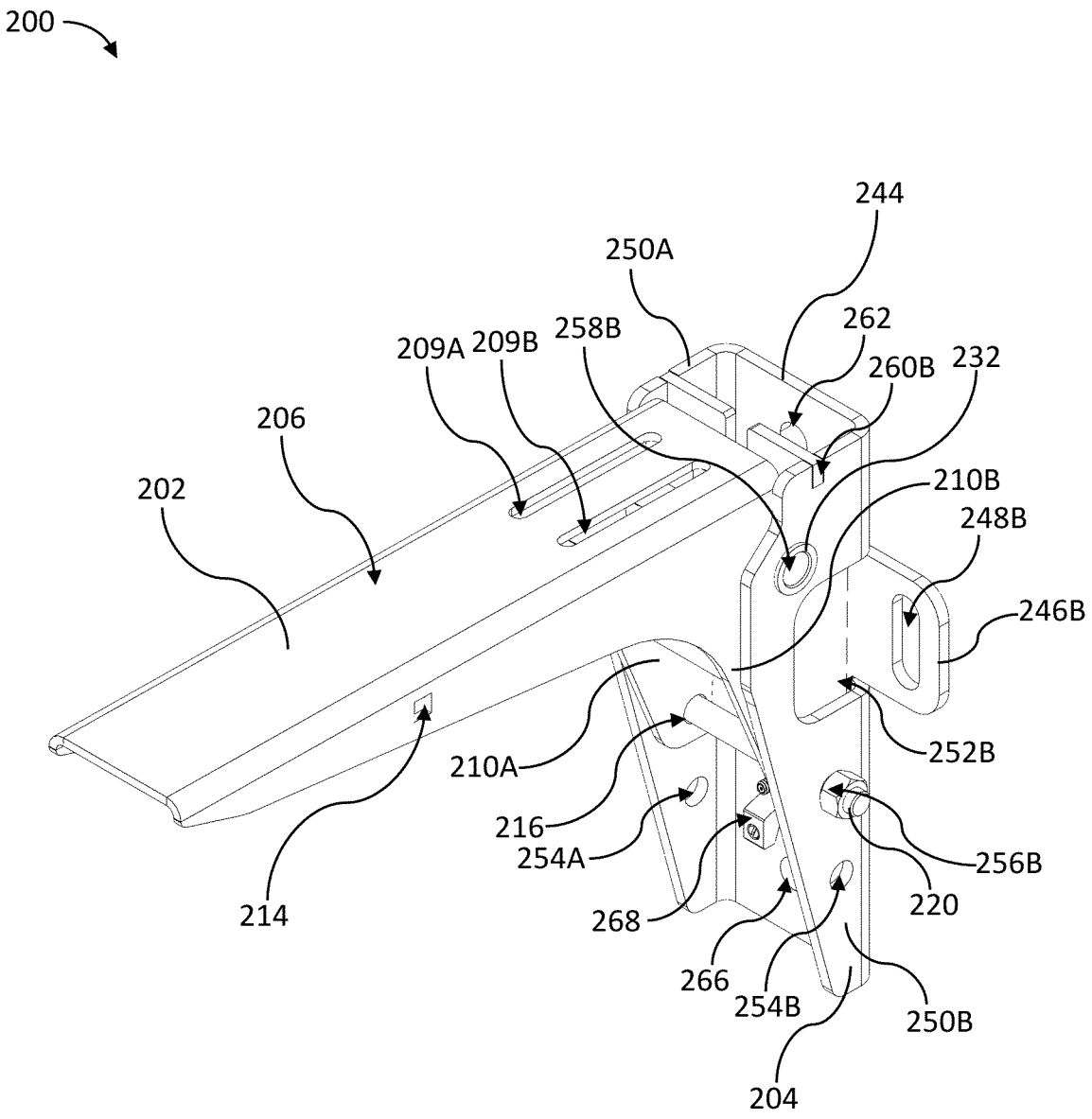
FIG. 5 illustrates a perspective view of a first bracket of a pool-cover bracket apparatus.
Figure 6:
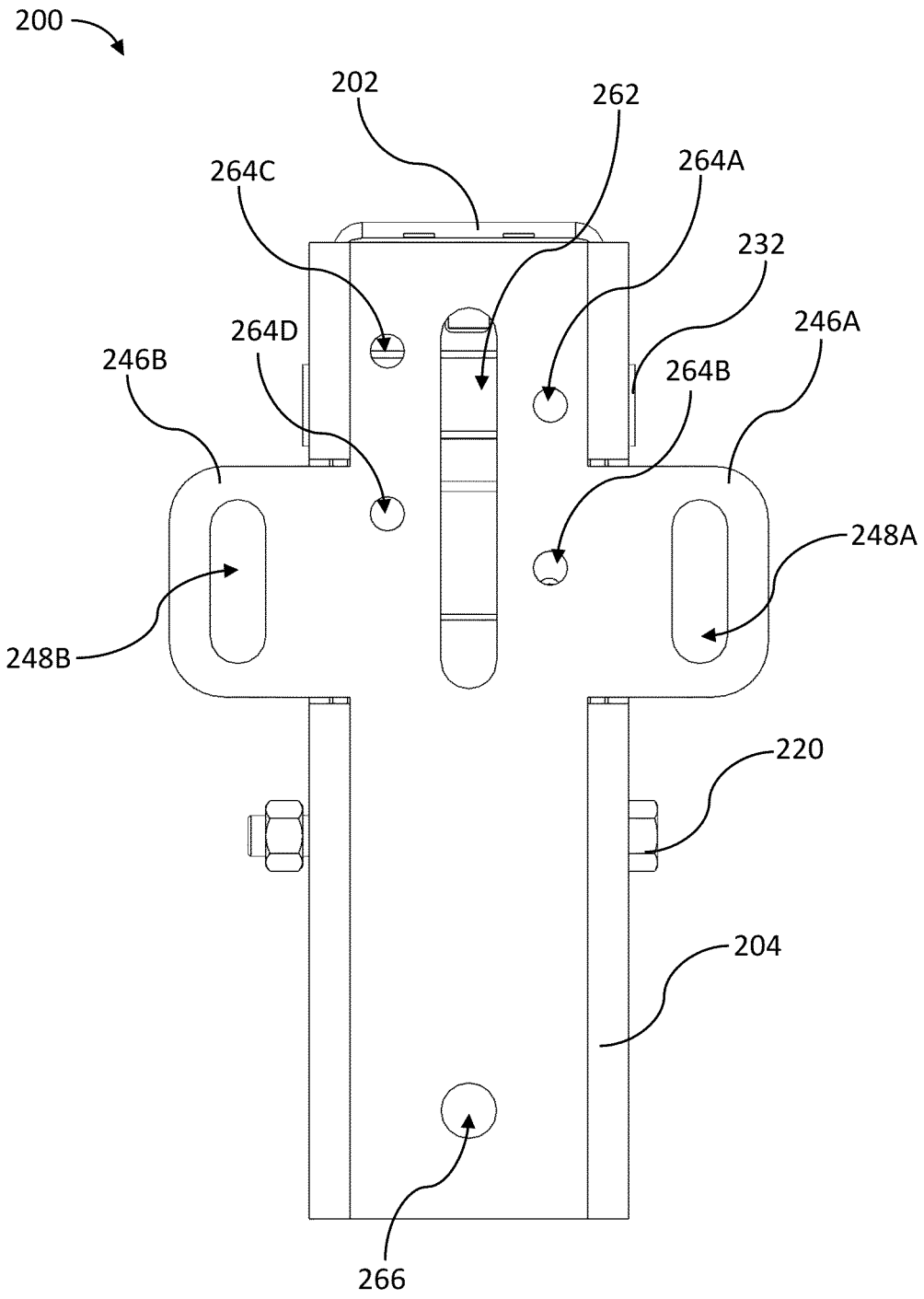
FIG. 6 illustrates a rear elevation view of a first bracket of a pool-cover bracket apparatus.
Figure 7:
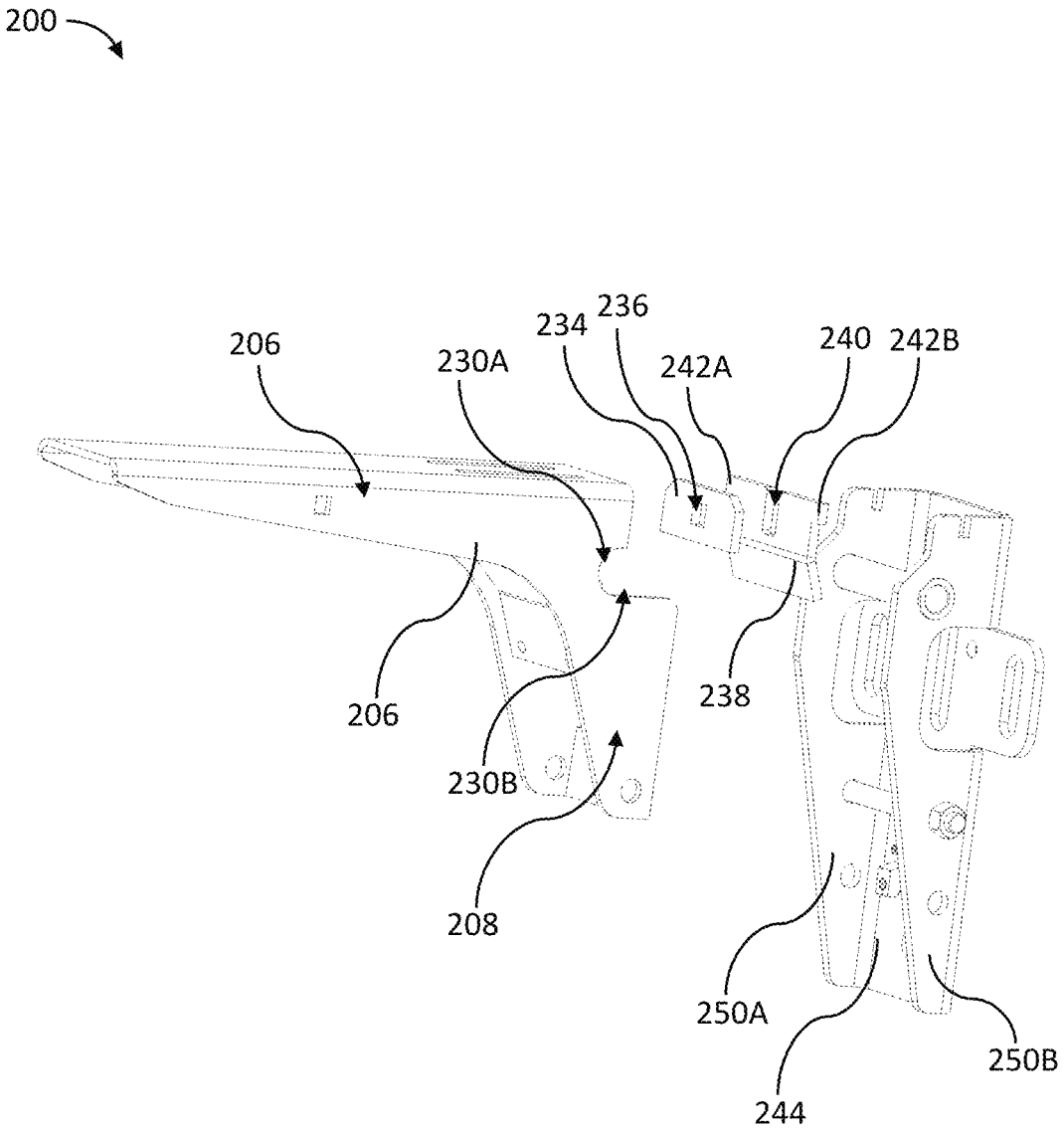
FIG. 7 illustrates an exploded view of a first bracket of a pool-cover bracket apparatus.

As shown in FIGS. 1-3, in one embodiment, a bracket housing system 100 and a pool-cover bracket apparatus 102 may work in tandem with each other or independently. The pool-cover bracket apparatus 102 may come in a variety of configurations and sizes. The bracket housing system 100 may include a trough 104 and the pool-cover brackets 102 that are removably attachable to the trough 104. The trough 104 may include a front side 106 that is positioned toward the water of a swimming pool, a rear side 108 opposite to and parallel to the front side 106, a top 110, a bottom 112, a left side 114 coupled to a first end of the front and rear sides 106, 108, and a right side 116 coupled to a second end of the front and rear sides 106, 108 and spaced apart from and parallel to the left side 114. A lip 118 may rest on and overhang the top edges of the front, left, and right sides 106, 114, 116, and in some embodiments, the rear side 108. The lip 118 may be manufactured from a piece of metal (e.g., a flat piece of metal), or other materials. The lip 118 may be multiple pieces of material coupled together via welding, or some other mechanical and/or chemical fastening mechanism. In some embodiments, the lip 118 may be a continuous piece of material.

The front side 106 of the trough 104 may include a cutaway portion 120 that runs a majority of the length of the front side 106. In other embodiments, the cutaway portion 120 may be more or less than a majority of the length of the front side 106. Coupled to an outer side of the front side 106 may be a first bracket 122A (e.g., L-shaped) proximate the first end and a second bracket 122B (e.g., L-shaped) proximate the second end. Both of the first and second L-shaped brackets 122A, 122B may be 90-degree brackets, or any other angle. The first and second L-shaped brackets 122A, 122B may each include a first panel 124A, 124B coupled to a second panel 126A, 126B at a substantially 90-degree angle. The first panel 124A, 124B may include a plurality of apertures 128A, 128B to receive fasteners so as to affix the trough 104 to a section of the swimming pool. The first and second L-shaped brackets 122A, 122B may be welded on, fastened via couplers, adhered, or some combination thereof. The front side may further include a third bracket 130A and a fourth bracket 130B that is the same as the third bracket 130A. Both the third and fourth brackets 130A, 130B may include a first plate 132A, 132B, a second plate 134A, 134B, and a third plate 136A, 136B. The second plate 134A, 134B may be interposed between and perpendicular to the first and third plates 132A, 132B, 134A, 134B. The first and third plates 132A, 132B, 134A, 134B may couple to the front side 106 and portions of the bottom 112. In some embodiments, portions of the second plate 134A, 134B may couple to the front side 106. The second plate 134A, 134B may include apertures. Cavities 138A, 138B may be created after the third and fourth brackets 130A, 130B are fastened to the front side 106. The cavities 138A, 138B may be accessed from a bottom going up or from the top going down. The cavities 138A, 138B are created by the space in between the first, second, and third plates 132A, 132B, 134A, 134B, 136A, 136B when coupled to the front side 106. The front side 106 may also include a plurality of apertures 140 that receive screws or other types of fasteners.

Referring to FIG. 3, the rear side 108 of the trough 104 may include a plurality of supports 142A-142D that extend from a top of the rear side 108 proximate the lip 118 and descend to the bottom 112. The plurality of supports 142A-142D may be substantially J-shaped. The rear side 108 may include a plurality of rear apertures 144A, 144B to receive screws or any other type of fastener. The rear side 108 may also include a rear bracket 146 that is coupled proximate the top 110 of the rear side 108. The rear bracket 146 includes a top bracket side 148, a rear bracket side 150 that contacts an outer surface of the rear side 108, a lower bracket side 152, a first lip 154 that descends from the top bracket side 148, and a second lip 156 that descends from the lower bracket side 152. The rear bracket 146 may include rear bracket apertures so as to receive fasteners to couple the rear bracket to the rear side. The lower bracket side 152 may include a plurality of slots 158 that are configured to receive ends of the plurality of supports 142A-142D so as to secure them therein.

Referring to FIG. 2, the bottom 112 may include a first bottom aperture 160 used to, for example, drain water from the trough 104. Furthermore, the bottom 112 may include a second bottom aperture 162 that is circumscribed by a cylindrical member 164. That is, the cylindrical member 164 is coupled to a lower surface of the bottom 112 and configured to define and protrude from the edges of the second bottom aperture 162.

The front side 106, rear side 108, and the bottom 112 may be made from a single piece of material; or, in some embodiments, the sides may be manufactured from multiple pieces of material and coupled together.

The trough 104 may include a cavity 166 that is configured to receive certain sizes of the pool-cover brackets. As shown, the cavity 166 may receive four pool-cover brackets 102, with a rear of the pool-cover brackets 102 being fastened to an inner side of the rear side 108. A front section of the pool-cover brackets 102, when placed in the trough's cavity 166, may receive a bracket support 168, a panel that spans across all of the front sections of the pool-cover brackets 102. While the trough 104 illustrates four pool-cover brackets 102 within the cavity 166, it will be appreciated that there may be more or less than four pool-cover brackets 102 positioned within the trough 104. Furthermore, in some embodiments, the trough 104 may vary in height, width, and length. As such, different numbers and sizes of the pool-cover brackets 102 may be used.

The pool-cover bracket apparatuses 102 may include a first bracket 200, a second bracket 300, a third bracket 400, and a fourth bracket 500. Some of the pool-cover brackets 102 may be interchangeable and used in the trough 104 as described above. Furthermore, some components of the below-described brackets may be interchangeable with other brackets.

As shown in FIGS. 4-7, the first bracket 200 may include a front section 202 and a rear section 204. The front section 202 may be coupled to the rear section 204 and may be removably attachable thereto. In some embodiments, the front section 202 may be hingedly coupled to the rear section 204, or at least capable of movement. The front section 202 may include an upper section 206 and a lower section 208 that is at a 90-degree angle from the upper section 206, or substantially a 90-degree angle. The upper section 206 may be capable of moving from a 90-degree angle to an angle that is greater or less than 90 degrees in relation to the rear section 204. The upper section 206 may include a first upper slot 209A and a second upper slot 209B. The upper section 206 may be generally flat with a first arm 210A that descends below a lower surface of the upper section 206 and forms a portion of the lower section 208. Similarly, the upper section 206 may include a second arm 210B that descends below a lower surface of the upper section 206 and forms a portion of the lower section 208. The first and second arms 210A, 210B may taper at a distal end of the upper section 206 and the lower section 208 from the junction of the upper and lower sections 206, 208. The first and second arms 210A, 210B terminate at an end of the upper section 206, distally from the lower section 208, and the first and second arms 210A, 210B terminate at an end of the lower section 208, distally from the upper section 206. The first and second arms 210A, 210B proximate the upper section 206 may include a first aperture 212 and a second aperture 214, respectively. The first and second arms 210A, 210B proximate an end distally from the upper section 206 may include a third aperture 216 and a fourth aperture 218, respectively. The third and fourth apertures 216, 218 may be configured to receive a first rod 220. The first rod 220 may be a bolt with a nut that couples the front section 202 to the rear section 204. The first rod 220 may also be a pin, screw, or another similar member. A first support panel 222 may be positioned between the first and second arms 210A, 210B proximate an end distally from the upper section 206 and behind the first rod 220. The first support panel 222 may be perpendicular to the first and second arms 210A, 210B. The first support panel 222 may include a panel aperture 224. Furthermore, a second panel 226 may be positioned between the first and second arms 210A, 210B and between the upper and lower sections 206, 208. The second panel 226 may be angled, with a lower portion of the second panel 226 having a second panel aperture 228A and a third panel aperture 228B. The first arm 210A may include a first notch 230A on the lower section 208. The second arm 210B may include a second notch 230B on the lower section 208. The first and second notches 230A, 230B may be configured to receive a second rod 232.

A back of the front section 202 may receive a first plate 234 that has a first member aperture 236. A second plate 238 may be angled with a plate slot 240. The second plate 238 may be may be positioned next to the first plate 234. Further, the second plate 238 may include a first projection 242A and a second projection 242B on an opposite side of the first projection 242A. The plate slot 243 may be interposed between the first projection 242A and the second projection 242B.

The rear section 204 may include a back panel 244 with a first wing 246A and a second wing 246B that extend outward from both sides and are in line with the back panel 244. The first wing 246A may include a first slot 248A, and the second wing 246B may include a second slot 248B, both slots being configured to receive fasteners so as to be adjustable on a y-axis. The rear section 204 may also include a third wing 250A and a fourth wing 250B that are next to the first and second arms 210A, 210B, respectively, when the front section 202 is coupled to the rear section 204. The third and fourth wings 250A, 250B may be at a 90-degree angle to the back panel 244 and the first and second wings 246A, 246B and, in some embodiments, at substantially a 90-degree angle. The third wing 250A may include a first wing aperture 252A, and the fourth wing 250B may include a second wing aperture 252B. The third wing 250A may further include a first aperture 254A, a second aperture 256A, and a third aperture 258A. The first or second aperture 254A, 256A may receive the first rod 220. The third aperture 258A may receive the second rod 232. The fourth wing 250B may include a fourth aperture 254B, a fifth aperture 256B, and a sixth aperture 258B. The fourth or fifth aperture 254B, 256B may receive the first rod 220. The sixth aperture 258B may receive the second rod 232. The third wing 250A at a top edge thereof includes a third wing notch 260A, and the fourth wing 250B at a top edge thereof includes a fourth wing notch 260B. The third and fourth wing notches 260A, 260B may be configured to receive the first and second projections 242A, 242B on the second plate 238, thereby further securing the front section 202 to the rear section 204.

The back panel 244 may include a slot 262, upper apertures 264A-264D, and a lower aperture 266. The slot 262 may be proximate the upper end of the rear section 204 and descend part of the way down the back panel 244. While apertures, slots, rods, and notches are shown on the front and/or rear sections, it will be understood that the sizing, location, and amount of the aforementioned may vary without departing from the present invention.

A fastening member 268 may be coupled to an inner surface of the back panel 244 at a lower end thereof. The fastening member 268 may include a back section 270 with a protrusion 272. The bottom of the protrusion 272 may have a channel 274. A first fastener 276 may protrude forward from the back section 270, and a second fastener 278 may pass from a front side of the protrusion 272, through the channel 274, and to the back section 270. The first bracket 200 may include an upper section 206 that is 13", or any other length.

Figure 8:
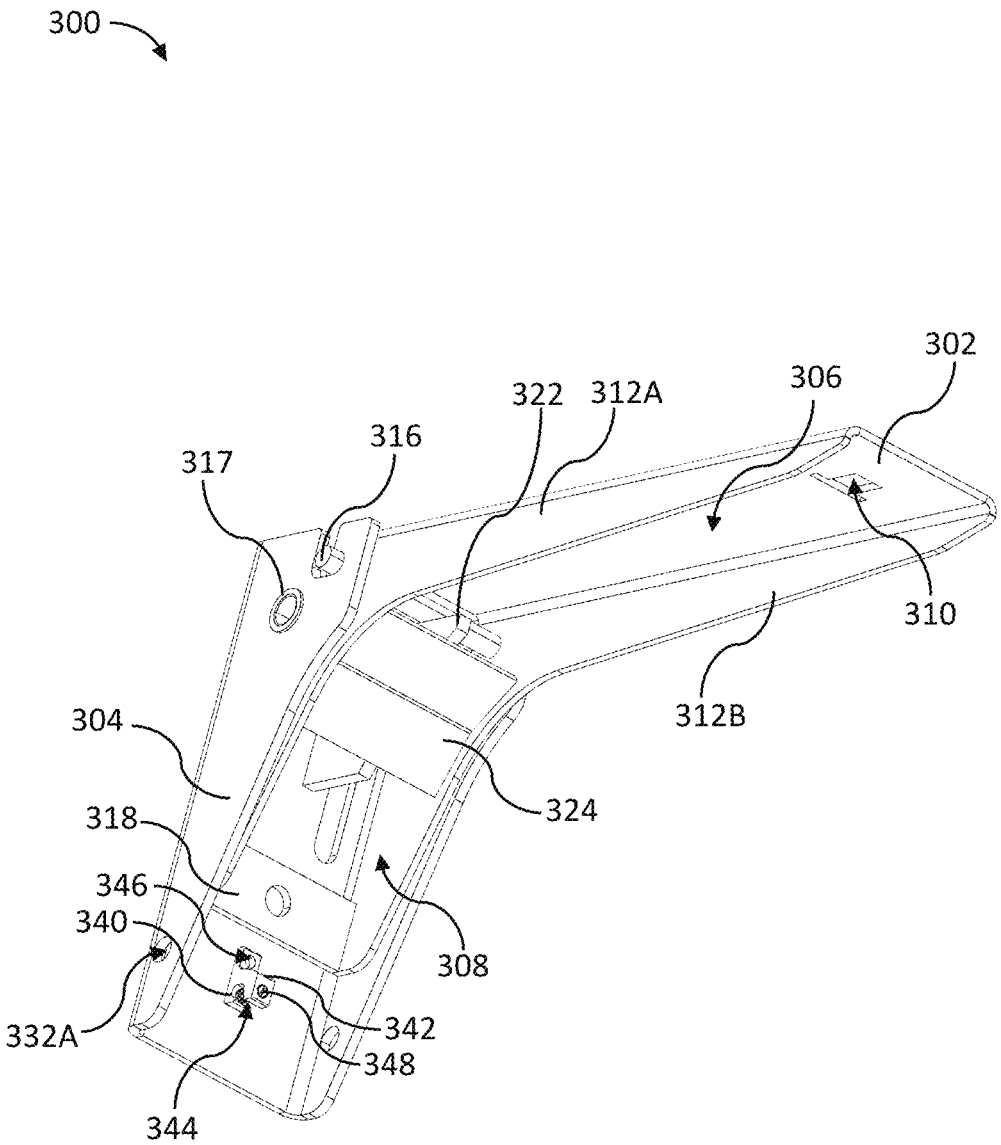
FIG. 8 illustrates a left side perspective view of a second bracket of a pool-cover bracket apparatus.
Figure 9:
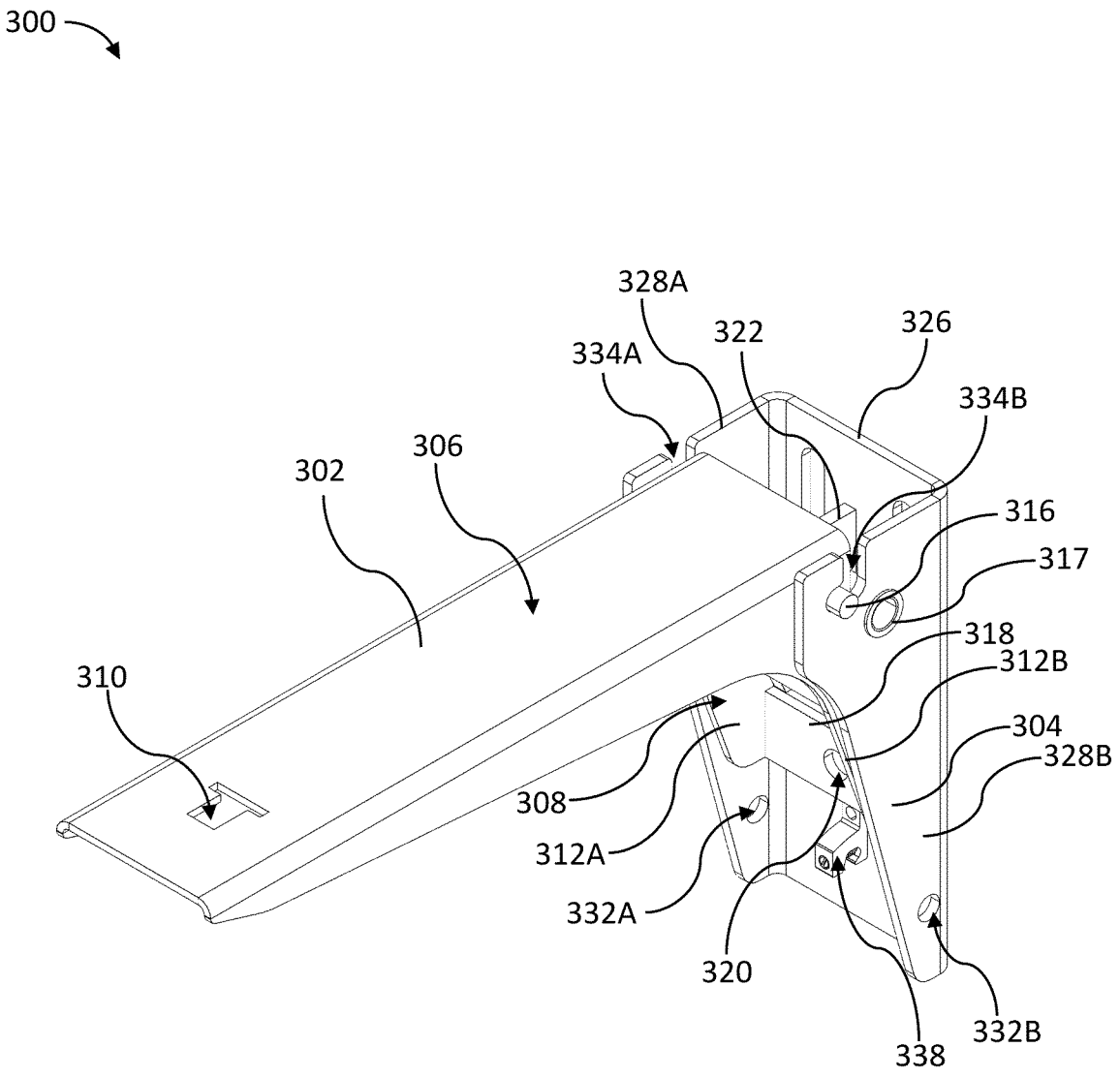
FIG. 9 illustrates a perspective view of a second bracket of a pool-cover bracket apparatus.
Figure 10:
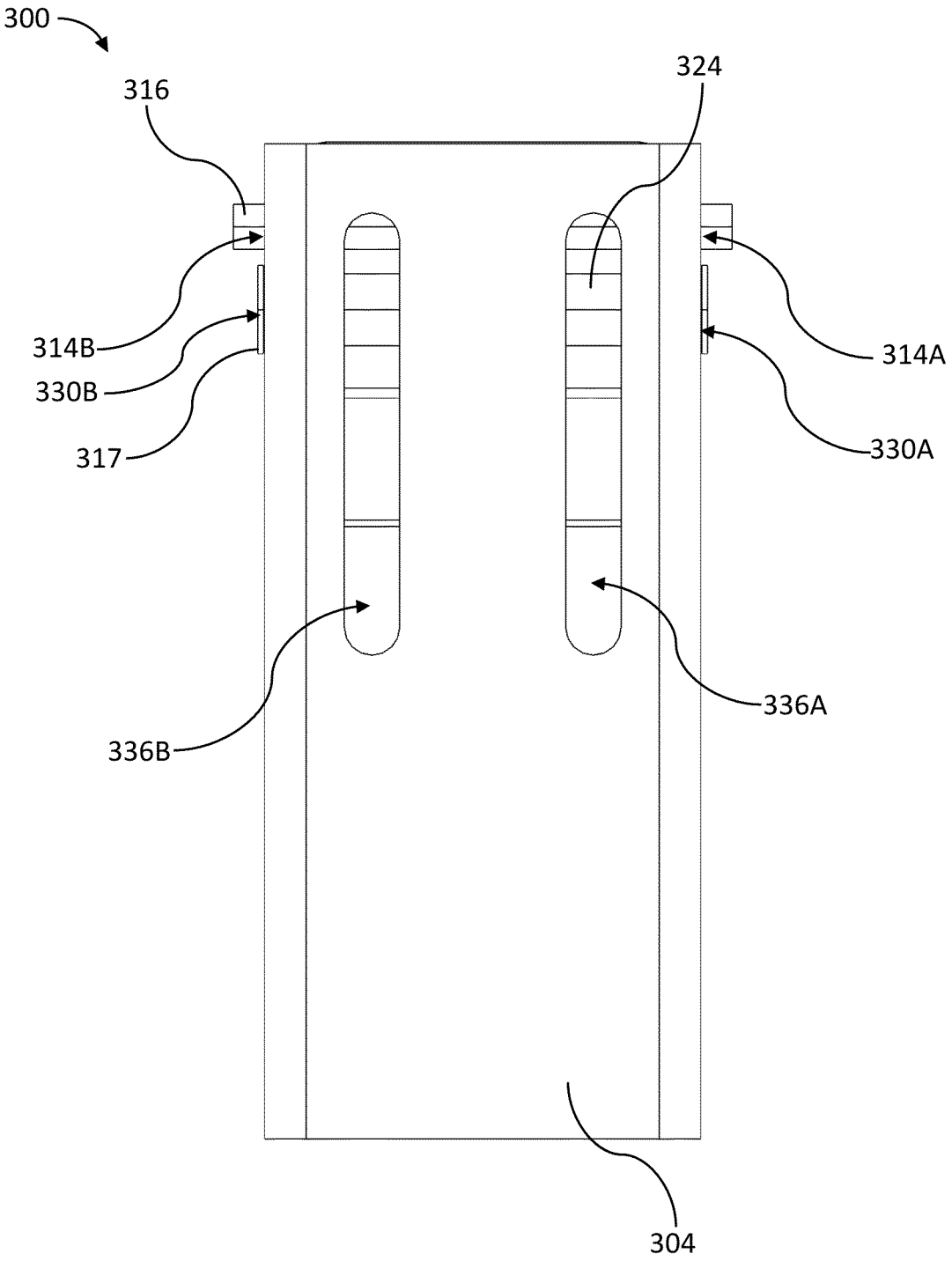
FIG. 10 illustrates a rear elevation view of a second bracket of a pool-cover bracket apparatus.
Figure 11:
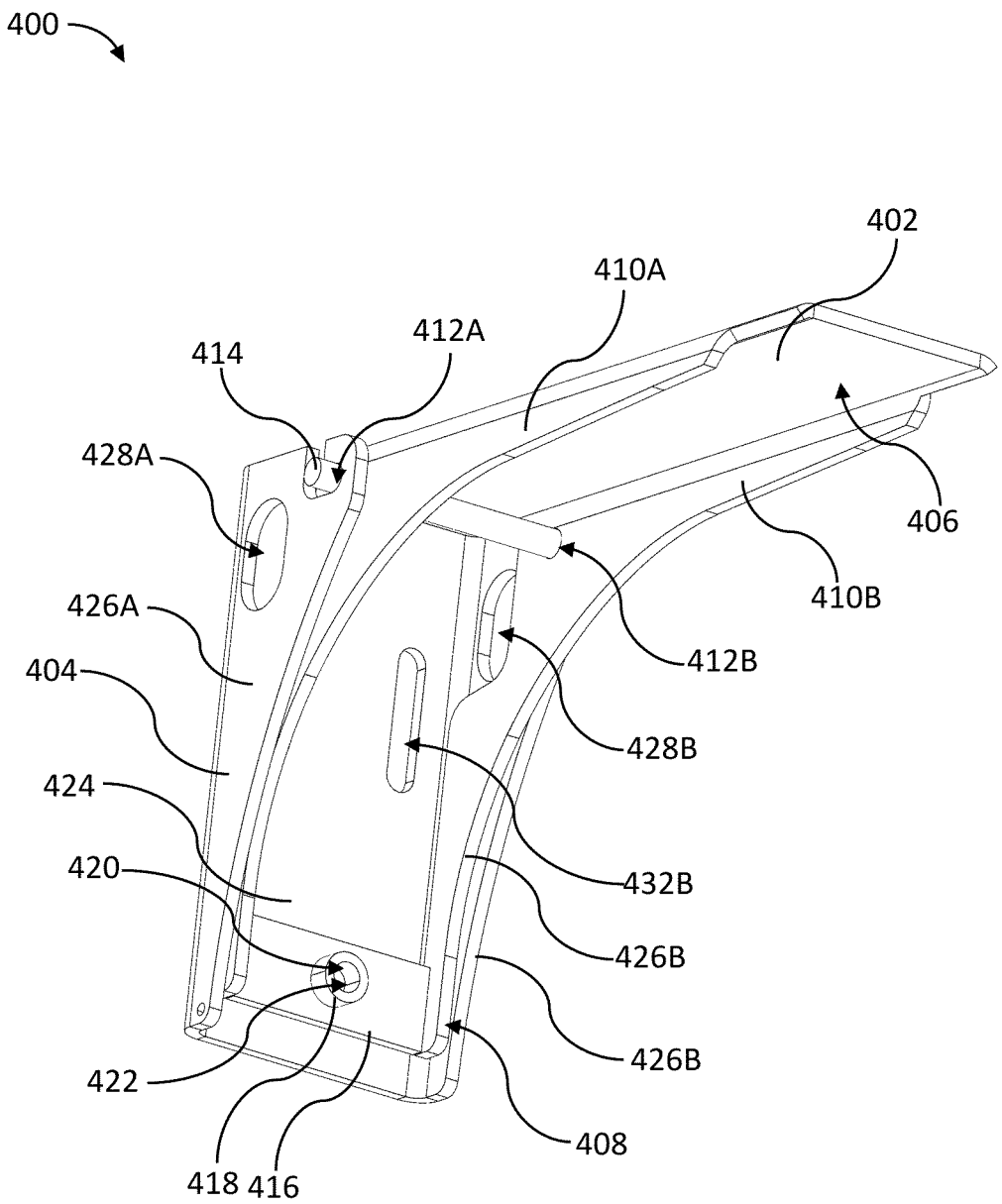
FIG. 11 illustrates a left side perspective view of a third bracket of a pool-cover bracket apparatus.
Figure 12:
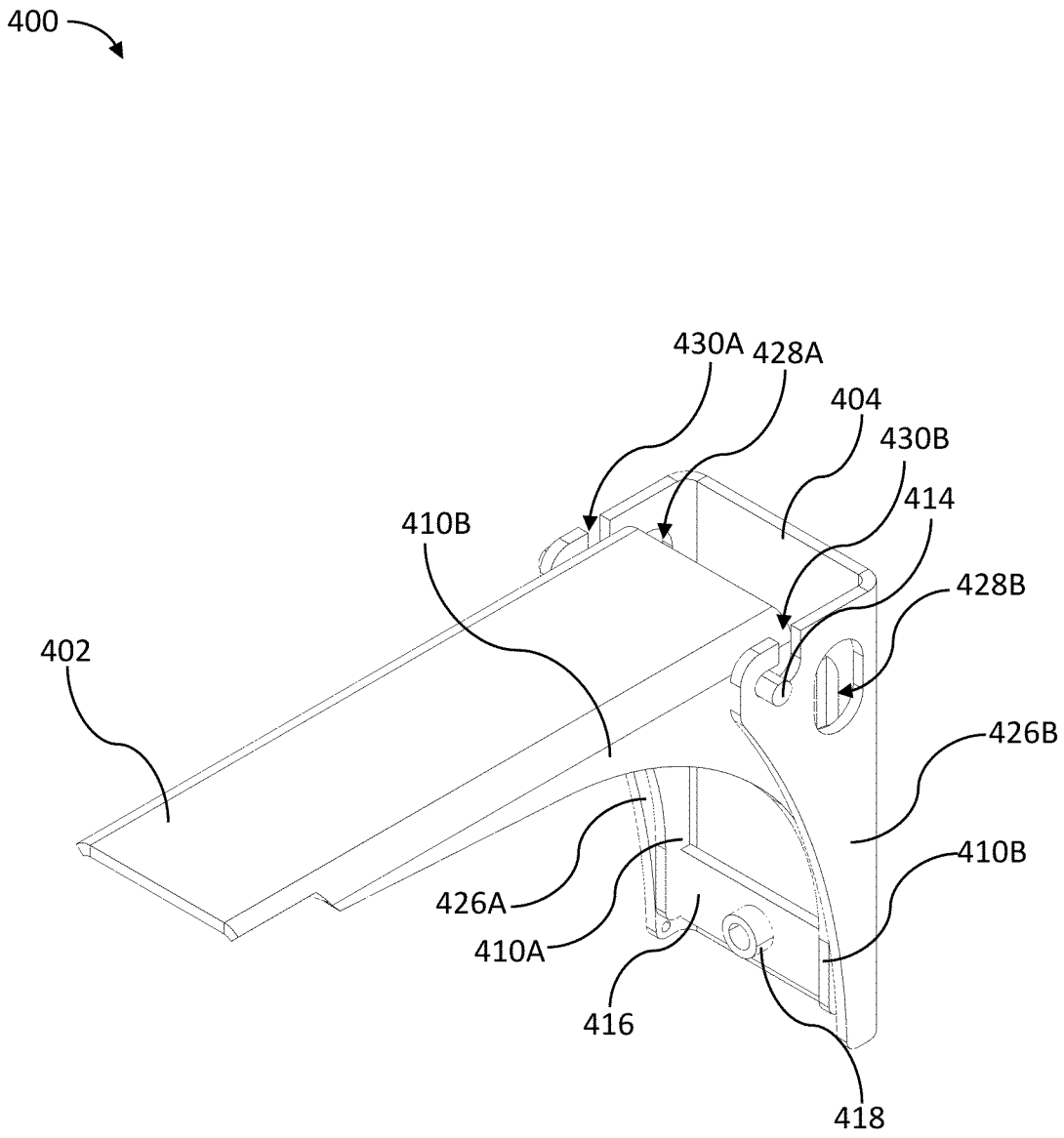
FIG. 12 illustrates a perspective view of a third bracket of a pool-cover bracket apparatus.
Figure 13:
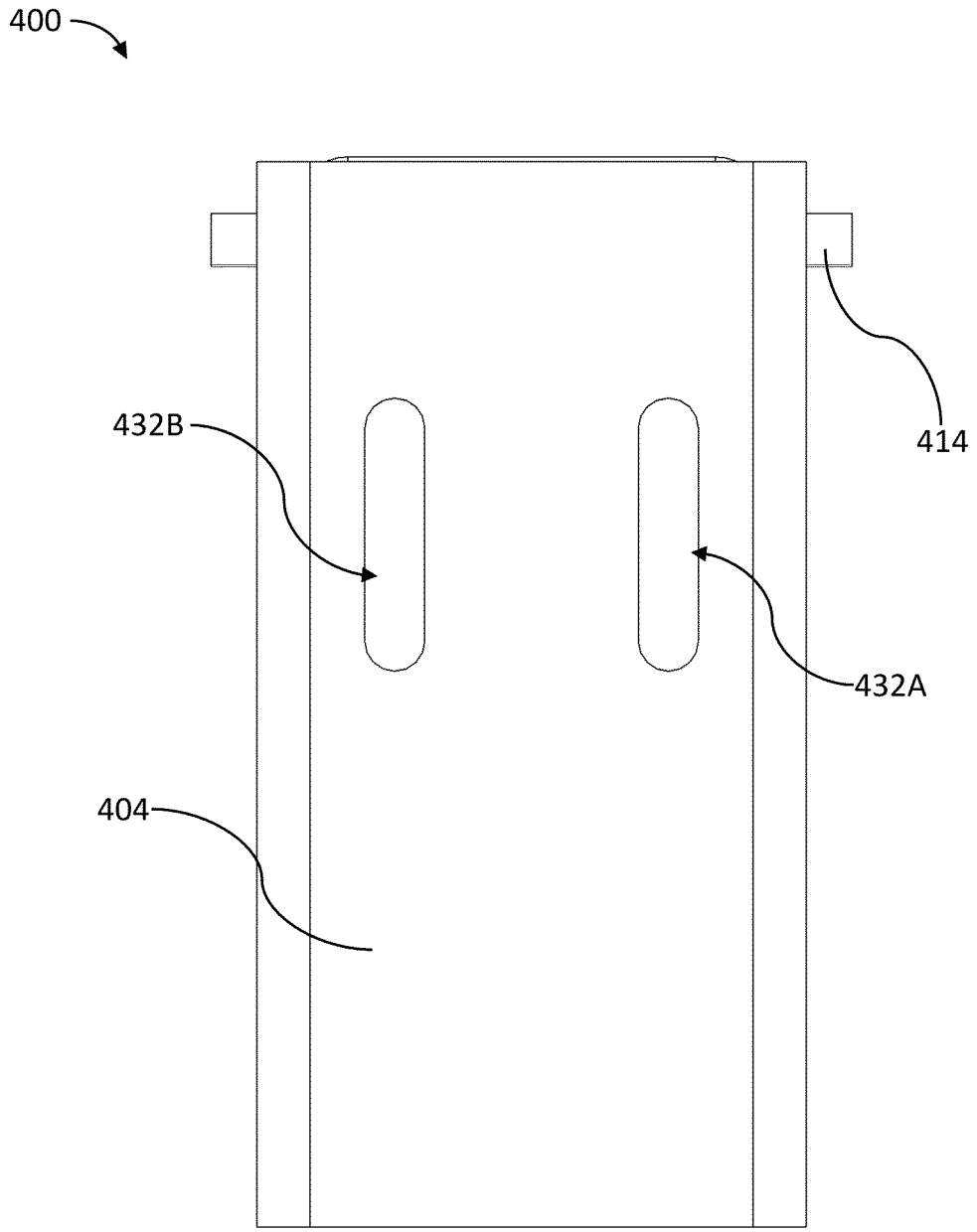
FIG. 13 illustrates a rear elevation view of a third bracket of a pool-cover bracket apparatus.
Figure 14:
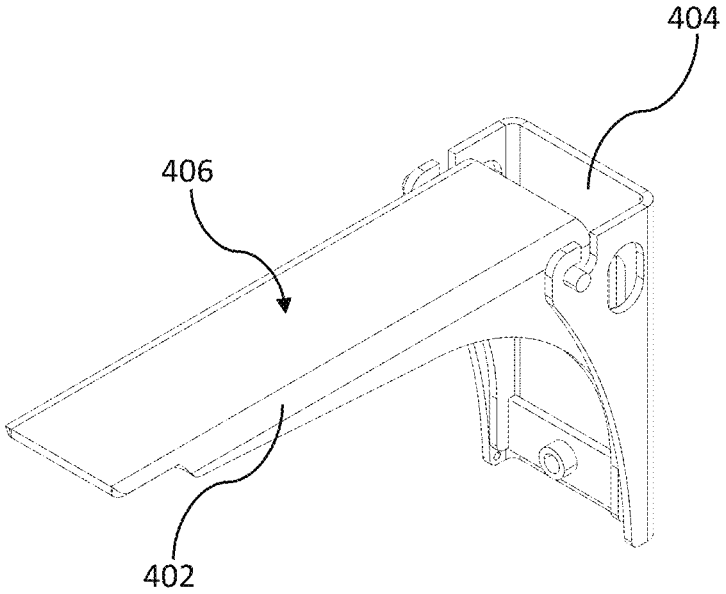
FIG. 14 illustrates a perspective view of a third bracket of a pool-cover bracket apparatus.
Figure 15:
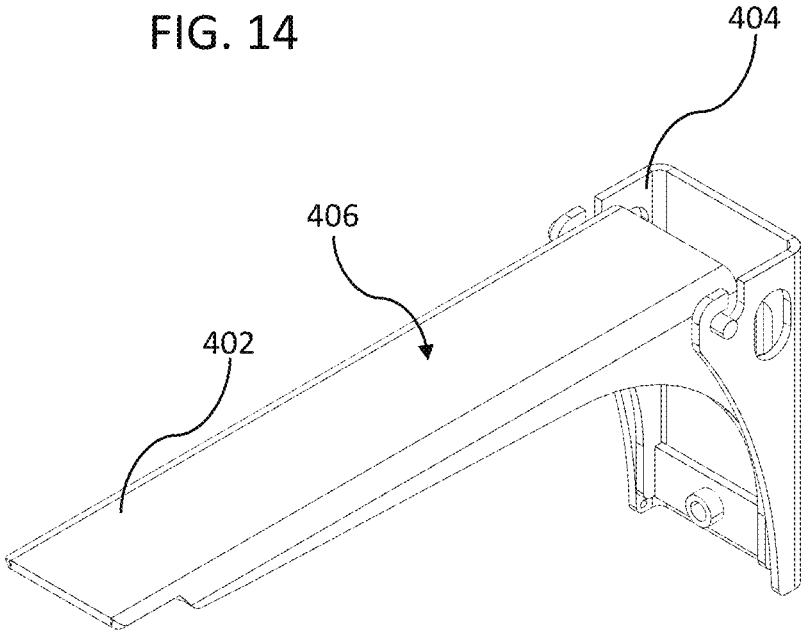
FIG. 15 illustrates a perspective view of a third bracket of a pool-cover bracket apparatus.
Figure 16:
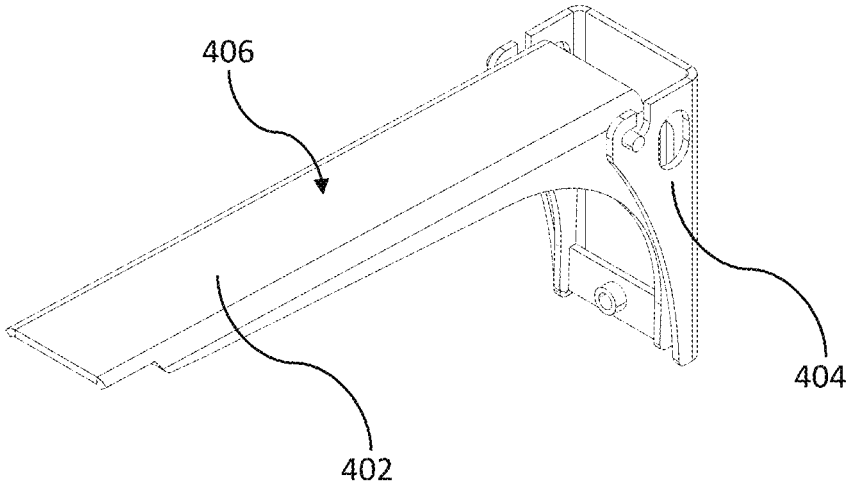
FIG. 16 illustrates a perspective view of a third bracket of a pool-cover bracket apparatus.
Figure 17:
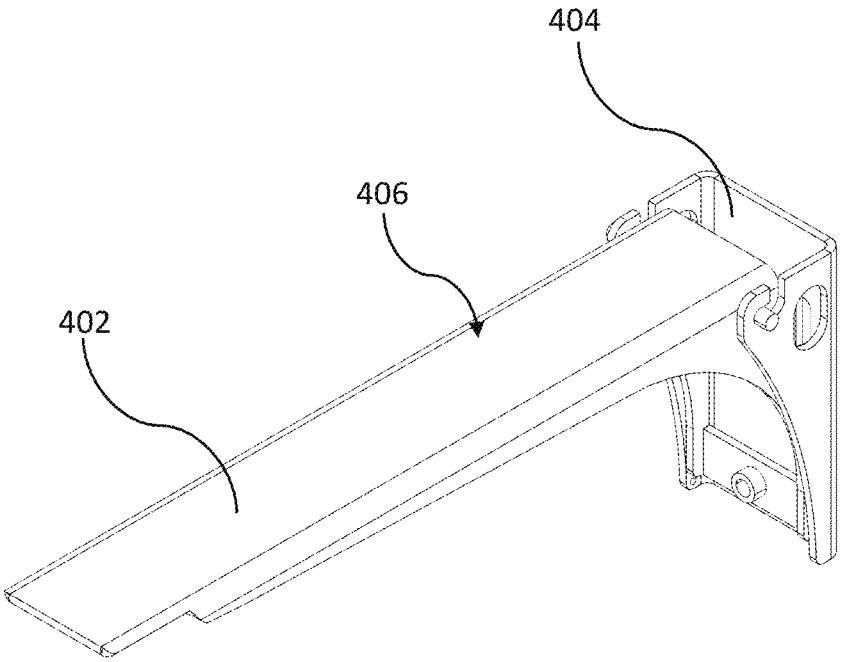
FIG. 17 illustrates a perspective view of a third bracket of a pool-cover bracket apparatus.
Figure 18:
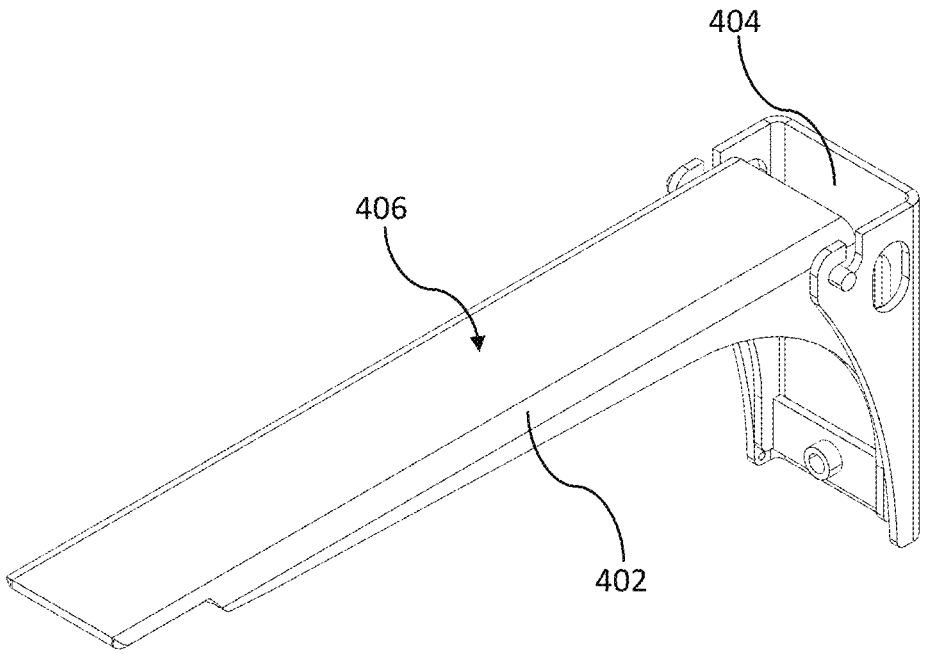
FIG. 18 illustrates a perspective view of a third bracket of a pool-cover bracket apparatus.
Figure 19:
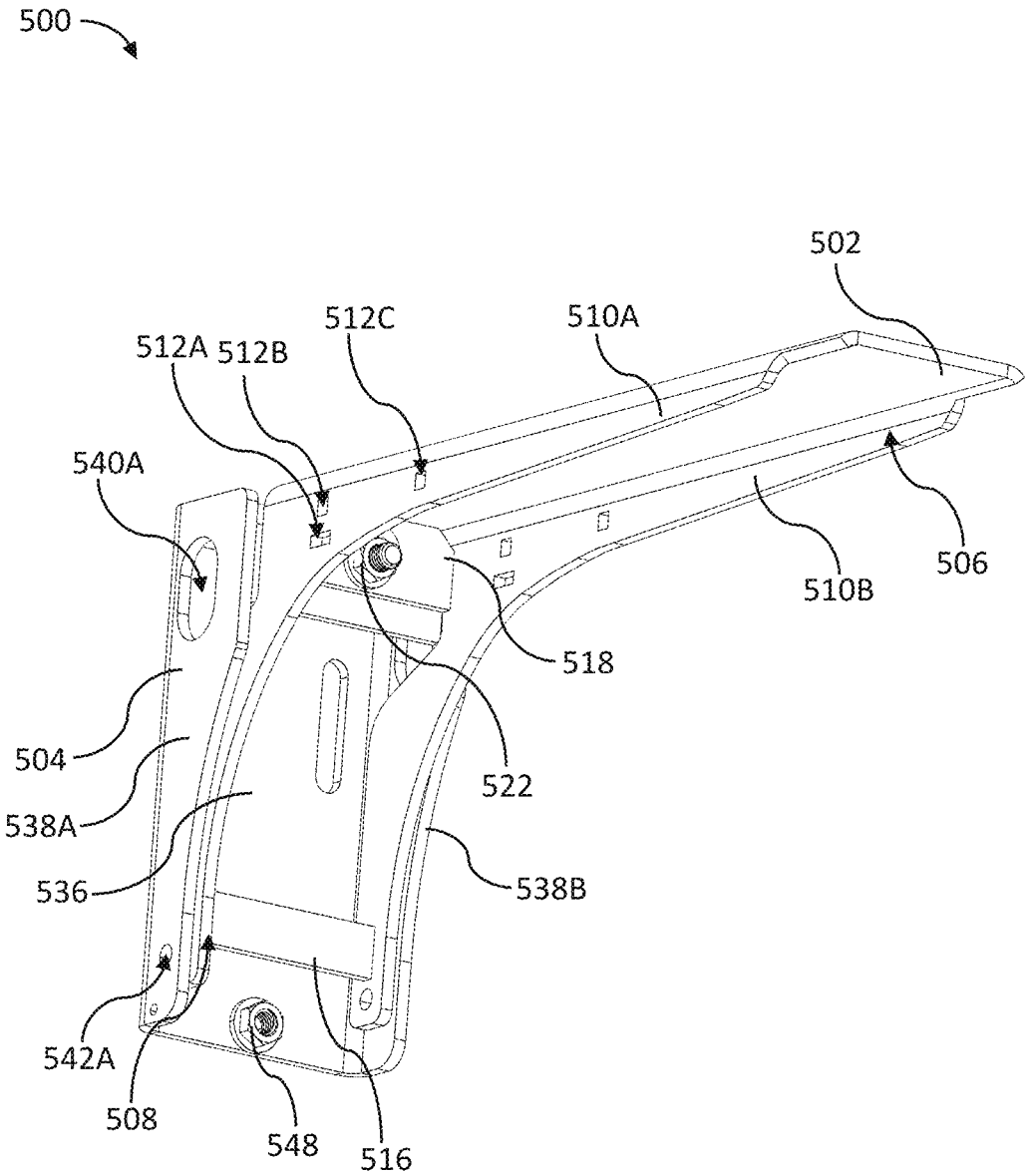
FIG. 19 illustrates a left side perspective view of a fourth bracket of a pool-cover bracket apparatus.
Figure 20:
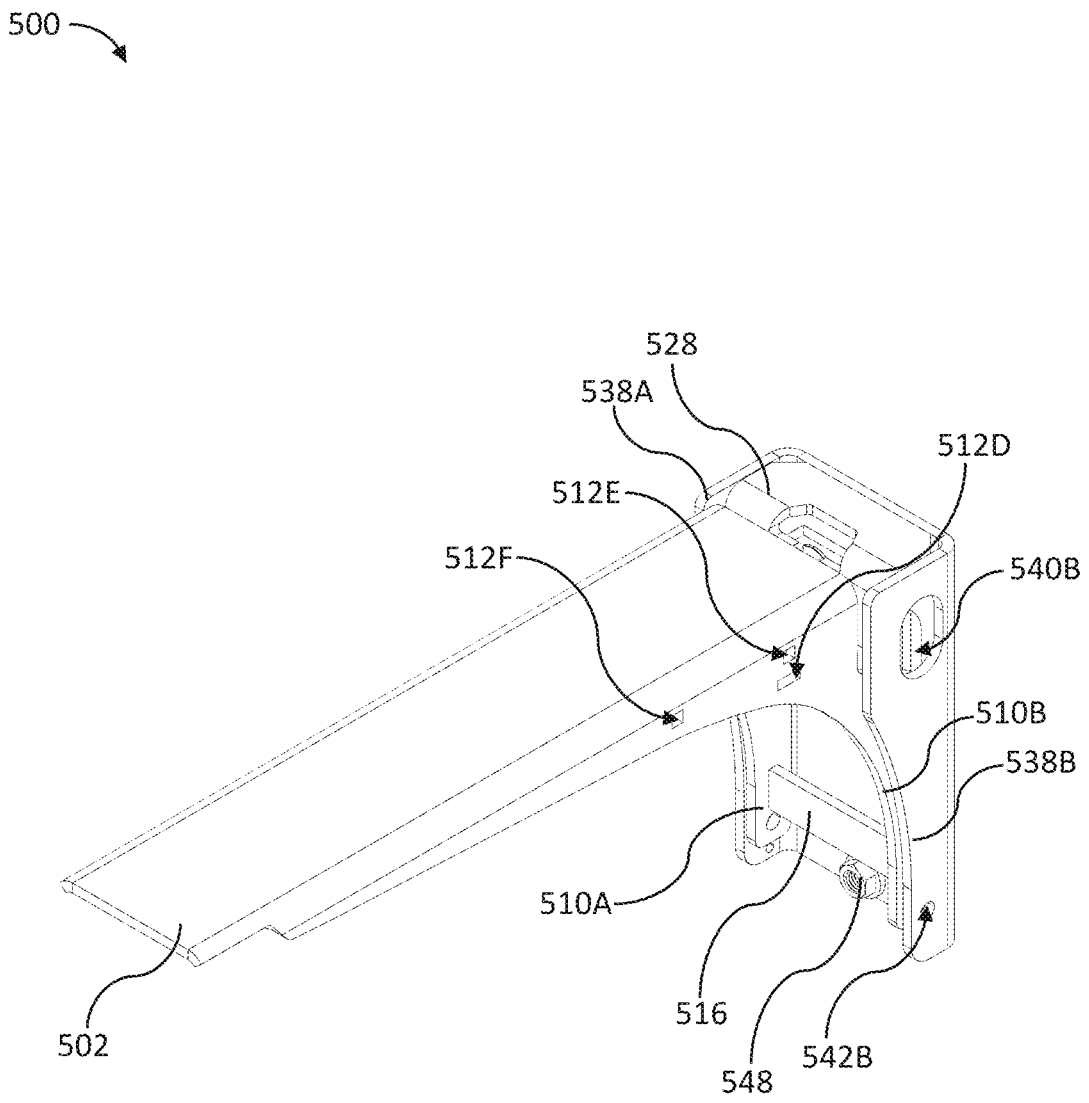
FIG. 20 illustrates a perspective view of a fourth bracket of a pool-cover bracket apparatus.
Figure 21:
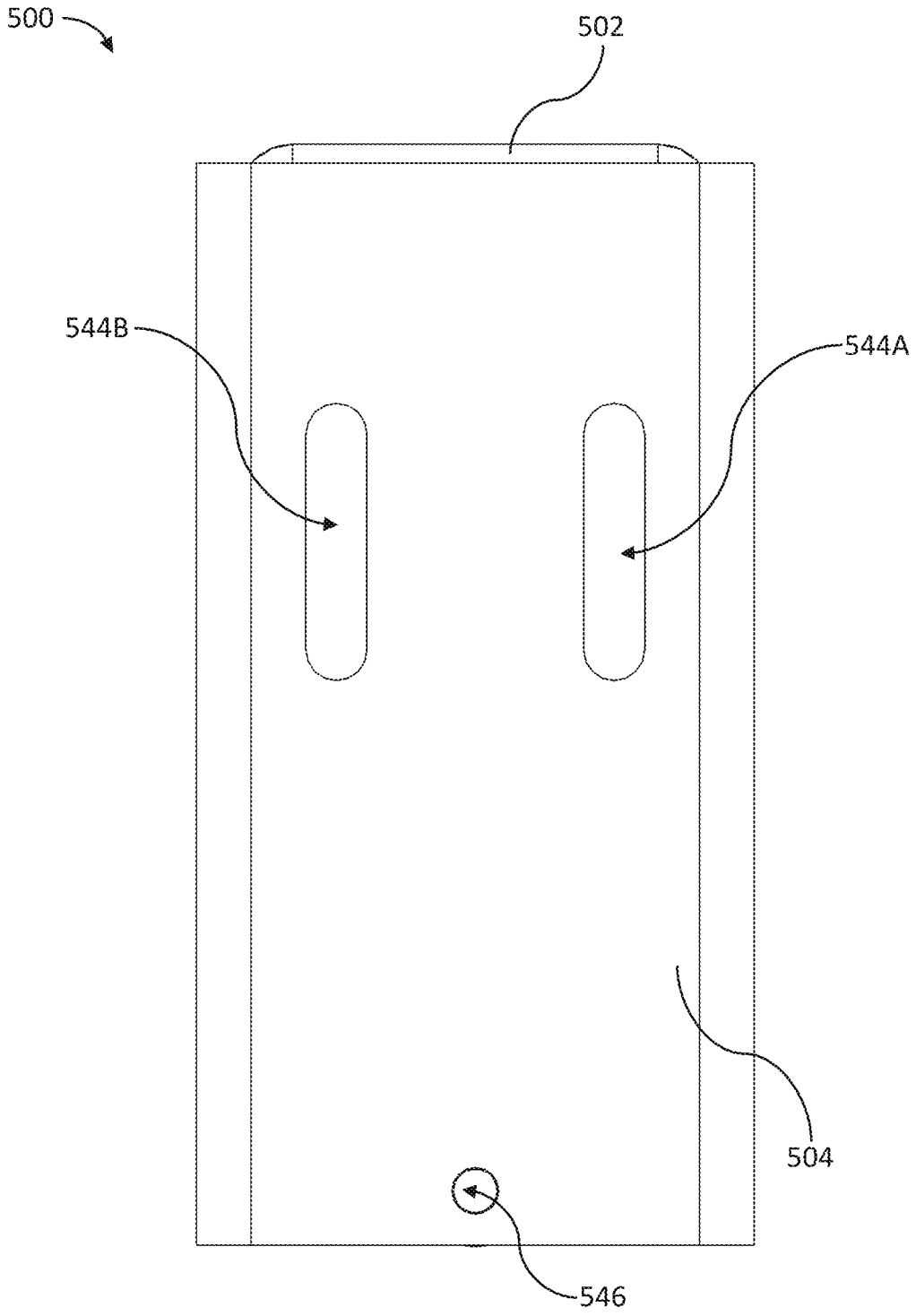
FIG. 21 illustrates a rear elevation view of a fourth bracket of a pool-cover bracket apparatus.
Figure 22:
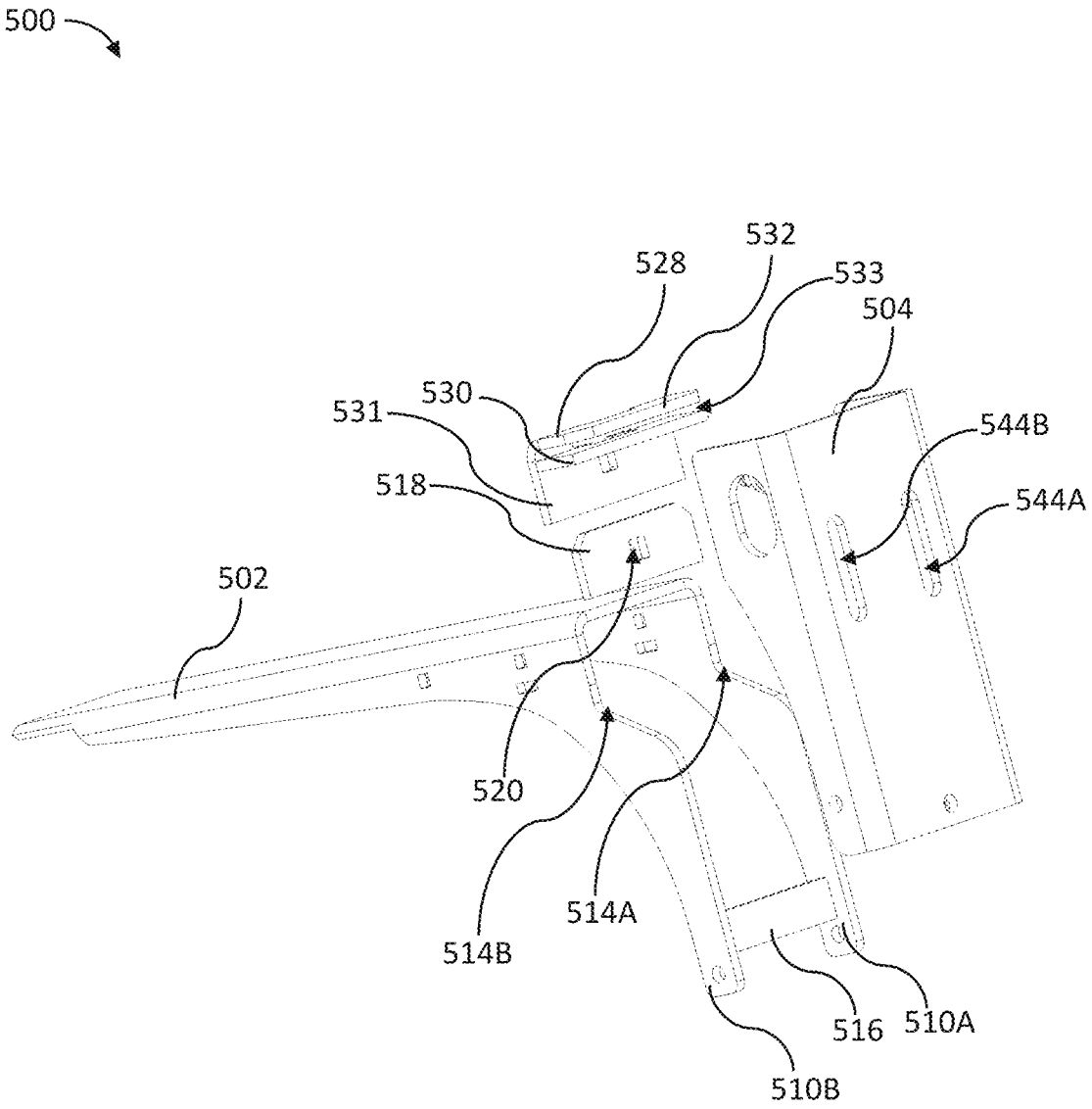
FIG. 22 illustrates an exploded view of a fourth bracket of a pool-cover bracket apparatus.
Figure 23:
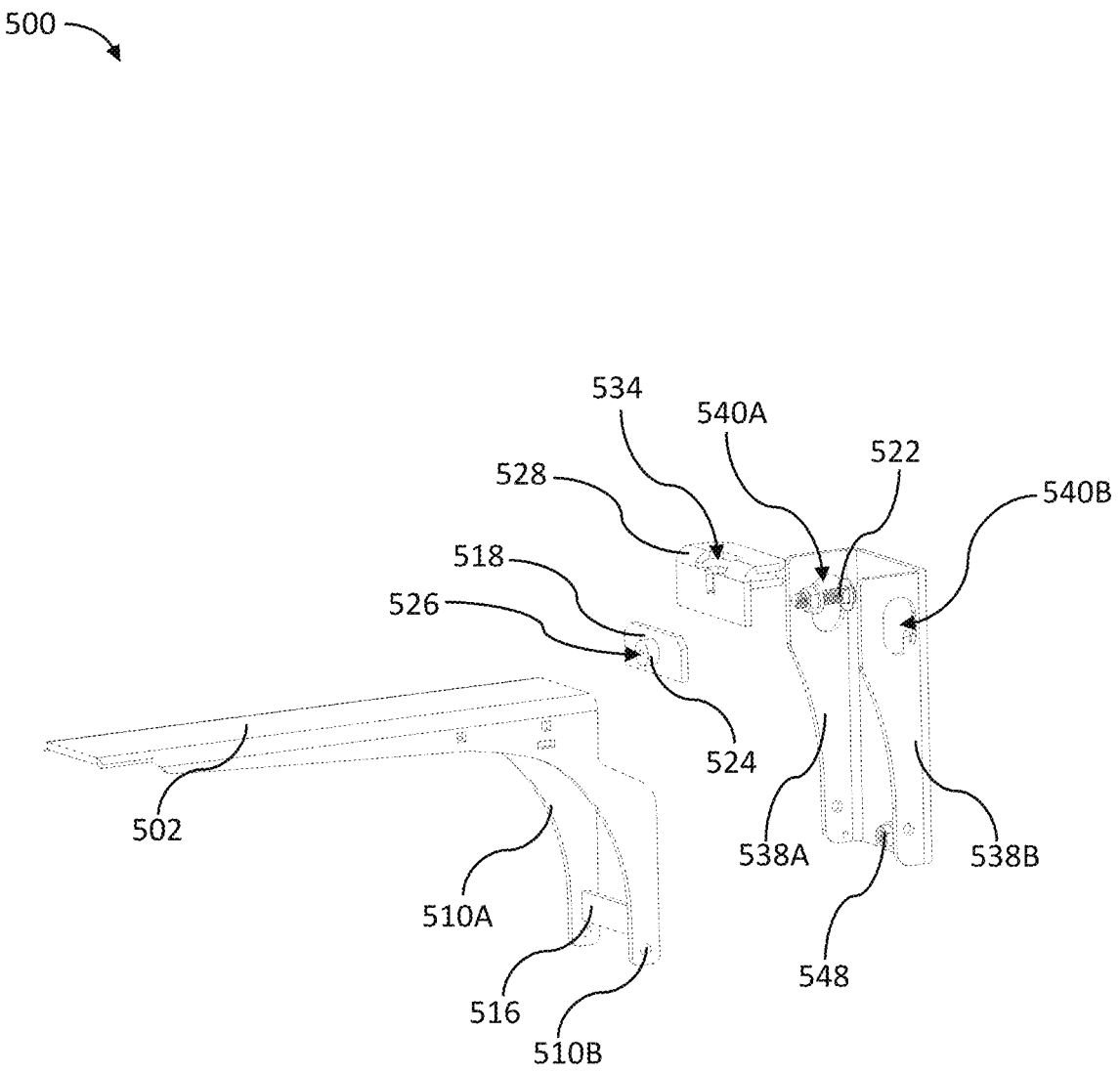
FIG. 23 illustrates an exploded view of a fourth bracket of a pool-cover bracket apparatus.

As shown in FIGS. 8-10, the second bracket 300 may include a front section 302 and a rear section 304. The front section 302 may be coupled to the rear section 304 and may be removably attachable thereto. In some embodiments, the front section 302 may be hingedly coupled to the rear section 304, or at least capable of movement. The front section 302 may include an upper section 306 and a lower section 308 that is at a 90-degree angle, or substantially a 90-degree angle, from the upper section 306. The upper section 306 may be capable of moving from a 90-degree angle to an angle that is greater or less than 90 degrees in relation to the rear section 304. The upper section 306 may include an upper section aperture 310 (e.g., a T-shaped aperture). The upper section 306 may be flat, or generally flat, with a first arm 312A that descends below a lower surface of the upper section 306 and forms a portion of the lower section 308. Similarly, the upper section 306 may include a second arm 312B that descends below a lower surface of the upper section 306 and forms a portion of the lower section 308. The first and second arms 312A, 312B may taper at a distal end from the upper section 306 and the lower section 308 from the junction of the upper and lower sections 306, 308. The first and second arms 312A, 312B terminate at an end of the upper section 306, distally from the lower section 308, and the first and second arms 312A, 312B terminate at end of the lower section 308, distally from the upper section 306. The first and second arms 312A, 312B proximate the junction of the upper and lower sections 306, 308 may include a first aperture 314A and a second aperture 314B, respectively. The first and second apertures 314A, 314B may be configured to receive a first rod 316 that interacts with the rear section 304, as discussed hereinafter. The first arm 312A may include a first notch on the lower section 308. The second arm 312B may include a second notch on the lower section 308. The first and second notches may be configured to receive a second rod 317; the second rod 317 may function with the rear section 304. A support panel 318 may be positioned between the first and second arms 312A, 312B proximate an end distally from the upper section 306. The support panel 318 may be perpendicular to the first and second arms 312A, 312B. The support panel 318 may include an aperture 320, which may be configured to receive a fastener. A back of the front section 302 may receive a first plate 322 that is configured to rest on and match a portion of the shape of a second plate 324. The first plate 322 may couple to the rear section 304 and the second plate 324. The second plate 324 may be positioned between the first and second arms 312A, 312B proximate the junction of the upper and lower sections 306, 308. The second plate 324 may be angled. The first and second plates 322, 324 may add additional support and rigidity to the second bracket 300.

The rear section 304 may include a back panel 326 with a first wing 328A and a second wing 328B. It will be appreciated that the first and second arms 312A, 312B from the front section 302 may be positioned next to the first and second wings 328A, 328B, respectively. The first and second wings 328A, 328B may taper as they move from an upper end to a lower end of the rear section 304. The first and second wings 328A, 328B proximate the upper end may include a first wing aperture 330A and a second wing aperture 330B, respectively, that are configured to receive the second rod 317. The first and second wings 328A, 328B may further include a third wing aperture 332A and a fourth wing aperture 332B at the lower end of the rear section 304, respectively. Furthermore, the first wing 328A may include a first notch 334A (e.g., an L- or J-shaped notch) that is on a top edge of the upper end. Likewise, the second wing 328B may include a second notch 334B (e.g., an L- or J-shaped notch) that is on a top edge of the upper end. The first and second notches 334A, 334B may be configured to receive the first rod 316. In particular, after the rod 316 is positioned in the upper section, the ends of the rod 316 may be placed into the notches 334A, 334B, moving downward and then forward, thereby securing the front section 302 to the rear section 304. The back panel 326 may include a first slot 336A and a second slot 336B that is parallel to the first slot 336A, both being spaced apart from each other. The slots 336A, 336B may be proximate the upper end of the rear section 304 and descend part of the way down the back panel 326. While apertures, slots, rods, and notches are shown on the front and/or rear sections, it will be understood that the sizing, location, and amount of the aforementioned may vary without departing from the present invention.

A fastening member 338 may be coupled to an inner surface of the back panel 326 at a lower end thereof. The fastening member 338 may include a back section 340 with a protrusion 342. The bottom of the protrusion 342 may have a channel 344. A first fastener may be positioned in a back section aperture 346 and a second fastener 348 may pass from a front side of the protrusion 342, through the channel 344, and to the back section 340. The fasteners may be screws or any other fastening mechanism.

As shown in FIGS. 11-18, the third bracket 400 may include a front section 402 and a rear section 404. The front section 402 may be coupled to the rear section 404 and may be removably attachable thereto. In some embodiments, the front section 402 may be hingedly coupled to the rear section 404, or at least capable of movement. The front section 402 may include an upper section 406 and a lower section 408 that is at a 90-degree angle, or substantially a 90-degree angle, from the upper section 406. The upper section 406 may be capable of moving from a 90-degree angle to an angle that is greater or less than 90 degrees in relation to the rear section 404. The upper section 406 may be generally flat with a first arm 410A that descends below a lower surface of the upper section 406 and forms a portion of the lower section 408. Similarly, the upper section 406 may include a second arm 410B that descends below a lower surface of the upper section 406 and forms a portion of the lower section 408. The first and second arms 410A, 410B may taper at a distal end of the upper section 406 and the lower section 408 from the junction of the upper and lower sections 406, 408. The first and second arms 410A, 410B terminate proximate an end of the upper section 406, distally from the lower section 408, and the first and second arms 410A, 410B terminate proximate an end of the lower section 408, distally from the upper section 406. The first and second arms 410A, 410B proximate the junction of the upper and lower sections 406, 408 may include a first aperture 412A and a second aperture 412B, respectively. The first and second apertures 412A, 412B may be configured to receive a rod 414 that interacts with the rear section 404, as discussed hereinafter. A support panel 416 may be positioned between the first and second arms 410A, 410B proximate an end distally from the upper section 406. The support panel 416 may be perpendicular to the first and second arms 410A, 410B. The support panel 416 may include a protrusion 418 (e.g., a cylinder) that has an aperture 420, the cylinder defines and circumscribes a panel aperture 422. The protrusion 418 may be configured to receive a fastener.

The rear section 404 may include a back panel 424 with a first wing 426A and a second wing 426B. It will be appreciated that the first and second arms 410A, 410B from the front section 402 may be positioned next to the first and second wings 426A, 426B, respectively. The first and second wings 426A, 426B may taper as they move from an upper end to a lower end of the rear section 404. The first and second wings 426A, 426B proximate the upper end may include a first wing aperture 428A and a second wing aperture 428B, respectively. Furthermore, the first wing 426A may include a first notch 430A (e.g., an L- or J-shaped notch) that is on a top edge of the upper end. Likewise, the second wing 426B may include a second notch 430B (e.g., an L- or J-shaped notch) that is on a top edge of the upper end. The first and second notches 430A, 430B may be configured to receive the rod 414. In particular, after the rod 414 is positioned in the upper section 406, the ends of the rod 414 may be placed into the notches 430A, 430B, moving downward and then forward, thereby securing the front section 402 to the rear section 404. The back panel 424 may include a first slot 432A and a second slot 432B that is parallel to the first slot 432A, both being spaced apart from each other. The slots 432A, 432B may be proximate the upper end of the rear section 404 and descend part of the way down the back panel 424. While apertures, slots, a rod, and notches are shown on the front and/or rear sections, it will be understood that the sizing, location, and amount of the aforementioned may vary without departing from the present invention.

It will be appreciated that the upper section 406 may vary in length so as to accommodate different pool cover sizes. As an example, the upper section 406 may be 13 inches (FIG. 11), 16 inches (FIG. 14), 18 inches (FIG. 15), 21 inches (FIG. 16), 27 inches (FIG. 17), 29 inches (FIG. 18), or shorter or longer than any of the aforementioned lengths. Furthermore, in some embodiments, the rear section 404 may vary in height.

As shown in FIGS. 19-23, the fourth bracket 500 may include a front section 502 and a rear section 504. The front section 502 may be coupled to the rear section 504 and may be removably attachable thereto. In some embodiments, the front section 502 may be hingedly coupled to the rear section 504, or at least capable of movement. The front section 502 may include an upper section 506 and a lower section 508 that is at a 90-degree angle, or substantially at 90 degrees, from the upper section 506. The upper section 506 may be capable of moving from a 90-degree angle to an angle that is greater or less than 90 degrees in relation to the rear section 504. The upper section 506 may be flat or generally flat with a first arm 510A that descends below a lower surface of the upper section 506 and forms a portion of the lower section 508. Similarly, the upper section 506 may include a second arm 510B that descends below a lower surface of the upper section 506 and forms a portion of the lower section 508. The first and second arms 510A, 510B may taper at a distal end of the upper section 506 and the lower section 508 from the junction of the upper and lower sections 506, 508. The first and second arms 510A, 510B terminate at an end of the upper section 506, distally from the lower section 508, and the first and second arms 510A, 510B terminate at end of the lower section 508, distally from the upper section 506. The first and second arms 510A, 510B proximate the junction of the upper and lower sections 506, 508 may include first arm apertures 512A, 512B, 512C and second arm apertures 512D, 512E, 512F, respectively. The first arm 510A may include a first notch 514A on the lower section 508. The second arm 510B may include a second notch 514B on the lower section 508. A support panel 516 may be positioned between the first and second arms 510A, 510B proximate an end distally from the upper section 506. The support panel 516 may be perpendicular to the first and second arms 510A, 510B.

A back of the front section 502 may receive a first plate 518. The first plate 518 may be designed to fit into a rear of the front section 502. The first plate 518 may have a first plate aperture 520 that is configured to receive a fastener 522. The fastener 522 may be a bolt and nut. In other embodiments, the fastener 522 may be a screw, pin, or other securement mechanism. A front of the first plate 518 may include a protrusion 524 that is configured to receive a portion of the fastener 522. The protrusion 524 may be cylindrical and include a protrusion aperture 526 in the center thereof. The first plate 518 may contact a second plate 528. The second plate 528 may be generally L-shaped and include a panel 530 that extends the same length as a top section 532 of the second plate 518 both of which may be at a 90-degree angle from a bottom section 531, with a gap 533 being positioned between the top section 532 and the panel 530. A second plate aperture 534, such as a T-shaped aperture, may be positioned on the bottom section 531 of the second plate 528 and between the top section 532 and the panel 530. It will be understood that the fastener may pass through both the second plate aperture 534, the first plate aperture 520, and the protrusion aperture 526.

The rear section 504 may include a back panel 536 with a first wing 538A and a second wing 538B. It will be appreciated that the first and second arms 510A, 510B from the front section 502 may be positioned next to the first and second wings 538A, 538B, respectively. The first and second wings 538A, 538B may taper as they move from an upper end to a lower end of the rear section 504. The first and second wings 538A, 538B proximate the upper end may include a first wing aperture 540A and a second wing aperture 540B, respectively. The first and second wings 538A, 538B may further include a third wing aperture 542A and a fourth wing aperture 542B at the lower end of the rear section 504, respectively. The back panel 536 may include a first slot 544A and a second slot 544B that is parallel to the first slot 544A, both being spaced apart from each other. The slots 544A, 544B may be proximate the upper end of the rear section 504 and descend part of the way down the back panel 536. Furthermore, the back panel 536 may include a lower aperture 546. While apertures, slots, rods, and notches are shown on the front and/or rear sections, it will be understood that the sizing, location, and amount of the aforementioned may vary without departing from the present invention. A fastening member 548 may be coupled to an inner surface of the back panel 536 at a lower end thereof. The fastening member 548 may include a nut and a bolt or other fastening mechanisms.

It will be understood that while various embodiments have been disclosed herein, other embodiments are contemplated. Further, certain embodiments of the present disclosure may include, incorporate, or otherwise comprise properties or features described in other embodiments. Consequently, various features of certain embodiments can be compatible with, combined with, included in, and/or incorporated into other embodiments of the present disclosure. Therefore, disclosure of certain features or components relative to a specific embodiment of the present disclosure should not be construed as limiting the application or inclusion of said features or components to the specific embodiment unless stated. As such, other embodiments can also include said features, components, members, elements, parts, and/or portions without necessarily departing from the scope of the present disclosure. The embodiments described herein are examples of the present disclosure. Accordingly, unless a feature or component is described as requiring another feature or component in combination therewith, any feature herein may be combined with any other feature of a same or different embodiment disclosed herein. Although only a few of the example embodiments have been described in detail herein, those skilled in the art will appreciate that modifications are possible without materially departing from the present disclosure described herein. Accordingly, all modifications may be included within the scope of this invention.

What is claimed is:

1. A pool-cover bracket apparatus comprising:
a front section comprising:
an upper section,
a lower section,
a first arm that descends below a lower surface of the upper section and forms a portion of the lower section, and
a second arm that descends below a lower surface of the upper section and forms a portion of the lower section;
a first plate positionable into a rear of the front section;
a second plate positionable between the first plate and a rear section; and
the rear section is removably attachable to the front section.

2. The pool-cover bracket apparatus of claim 1, wherein the upper section and the lower section are generally at a 90-degree angle.

3. The pool-cover bracket apparatus of claim 1, wherein the first arm and second arms taper distally from the junction of the upper and lower sections.

4. The pool-cover bracket apparatus of claim 1, wherein the first arm comprises a plurality of first arm apertures.

5. The pool-cover bracket apparatus of claim 1, wherein the second arm comprises a plurality of second arm apertures.

6. The pool-cover bracket apparatus of claim 1, further comprising a support panel that is positioned between the first and second arms.

7. The pool-cover bracket apparatus of claim 1, wherein the first arm comprises a first notch.

8. The pool-cover bracket apparatus of claim 1, wherein the second arm comprises a second notch.

9. The pool-cover bracket apparatus of claim 1, wherein the first plate comprises a first plate aperture.

10. The pool-cover bracket apparatus of claim 1, further comprising a fastening member that couples to the rear section.

11. The pool-cover bracket apparatus of claim 1, further comprising a fastener that interacts with the first plate and the second plate to adjust the front section.

12. The pool-cover bracket apparatus of claim 1, wherein the second plate comprises a top section, a bottom section, and a panel.

13. The pool-cover bracket apparatus of claim 1, wherein the second plate comprises a second plate aperture.

14. The pool-cover bracket apparatus of claim 1, wherein the rear section comprises a first wing and a second wing.

15. A pool-cover bracket apparatus comprising:
a front section comprising:
an upper section,
a lower section,
a first arm that descends below a lower surface of the upper section and forms a portion of the lower section, and
a second arm that descends below a lower surface of the upper section and forms a portion of the lower section;
a first plate positionable into a rear of the front section;
a second plate positionable between the first plate and a rear section; and
the rear section is removably attachable to the front section, the rear section comprising:
a back panel,
a first wing extending forward from the back panel and proximate the first arm, and
a second wing extending forward from the back panel and proximate the second arm.

16. The pool-cover bracket apparatus of claim 15, wherein the first plate comprises a first plate aperture and a protrusion, where the first plate aperture is located.

17. The pool-cover bracket apparatus of claim 15, wherein the first and second wings taper from an upper end to a lower end.

18. The pool-cover bracket apparatus of claim 15, wherein the first wing comprises a first wing aperture, and the second wing comprises a second wing aperture.

19. The pool-cover bracket apparatus of claim 15, wherein the back panel comprises one or more slots.

20. A pool-cover bracket apparatus comprising:
a front section comprising:
an upper section,
a lower section,
a first arm that descends below a lower surface of the upper section and forms a portion of the lower section, and
a second arm that descends below a lower surface of the upper section and forms a portion of the lower section;
a first plate positionable into a rear of the front section, the first plate comprising a protrusion with a first plate aperture;
a second plate positionable between the first plate and a rear section, the second plate comprising a top section, a bottom section, and a panel;
the rear section is removably attachable to the front section, the rear section comprising:
a back panel,
a first wing extending forward from the back panel and proximate the first arm, and
a second wing extending forward from the back panel and proximate the second arm;
a fastener that secures the front section, the first plate, the second plate, and the rear section together.

* * * * *